US009208646B2

(12) United States Patent
Rakestraw et al.

(10) Patent No.: US 9,208,646 B2
(45) Date of Patent: Dec. 8, 2015

(54) ELECTRONIC GAMING DEVICE WITH WHEEL FUNCTIONALITY

(71) Applicants: Simon Rakestraw, Decatur, GA (US); Donald Rollo, Dacula, GA (US)

(72) Inventors: Simon Rakestraw, Decatur, GA (US); Donald Rollo, Dacula, GA (US)

(73) Assignee: CADILLAC JACK, INC., Duluth, GA (US)

( * ) Notice: Subject to any disclaimer, the term of this patent is extended or adjusted under 35 U.S.C. 154(b) by 0 days.

(21) Appl. No.: 13/654,793

(22) Filed: Oct. 18, 2012

(65) Prior Publication Data

US 2014/0113698 A1 Apr. 24, 2014

(51) Int. Cl.
*G07F 17/34* (2006.01)
*G07F 17/32* (2006.01)

(52) U.S. Cl.
CPC ..... *G07F 17/3239* (2013.01); *G07F 17/3262* (2013.01); *G07F 17/3265* (2013.01); *G07F 17/34* (2013.01)

(58) Field of Classification Search
CPC ..... A63F 13/10; A63F 2300/10; G07F 17/32; G07F 17/3262; G07F 17/3265; G07F 17/3239; G07F 17/34
USPC ..... 463/16–20, 36–37; 273/142 R, 143 R, 273/142 H, 142 HA, 138.2
See application file for complete search history.

(56) References Cited

U.S. PATENT DOCUMENTS

| | | | | |
|---|---|---|---|---|
| 7,789,756 | B2 * | 9/2010 | Jones et al. | 463/37 |
| 8,075,384 | B2 * | 12/2011 | Jones et al. | 463/16 |
| 8,535,141 | B2 * | 9/2013 | Rommerdahl et al. | 463/20 |
| 8,801,517 | B2 * | 8/2014 | Walker et al. | 463/16 |
| 2006/0026521 | A1 * | 2/2006 | Hotelling et al. | 715/702 |
| 2008/0113712 | A1 * | 5/2008 | Leblanc et al. | 463/16 |
| 2010/0267449 | A1 * | 10/2010 | Gagner et al. | 463/30 |
| 2011/0034241 | A1 * | 2/2011 | Englman et al. | 463/27 |
| 2011/0118014 | A1 * | 5/2011 | Mitchell et al. | 463/30 |
| 2013/0120375 | A1 * | 5/2013 | Jin et al. | 345/420 |

* cited by examiner

*Primary Examiner* — Paul A D'Agostino
*Assistant Examiner* — David Duffy
(74) *Attorney, Agent, or Firm* — CF 3; Stephen Eisenmann

(57) ABSTRACT

Examples disclosed herein relate to systems and methods, which may receive wagers on one or more paylines. The systems and methods may utilize one or more objects in a wheel-based game. The systems and methods may determine one or more payouts based on the one or more wheel positions. The systems and methods may display one or more presentations based on the one or more wheel positions.

16 Claims, 21 Drawing Sheets

ELECTRONIC GAMING DEVICE WITH WHEEL FUNCTIONALITY

FIELD

The subject matter disclosed herein relates to an electronic gaming device. More specifically, the disclosure relates to an electronic gaming device, which provides game play with one or more wheel functionalities. Further, the disclosure relates to utilizing wheel-based functionality and wheel-based presentations in the base game and/or the bonus game to enhance the gaming experience.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successful matches the predetermined winning symbols in one of the predetermined patterns. One or more combinations of symbols may generate a bonus game. A new way of delivering game play includes providing wheel-based functionality and/or wheel-based presentations in the base game and/or the bonus game.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
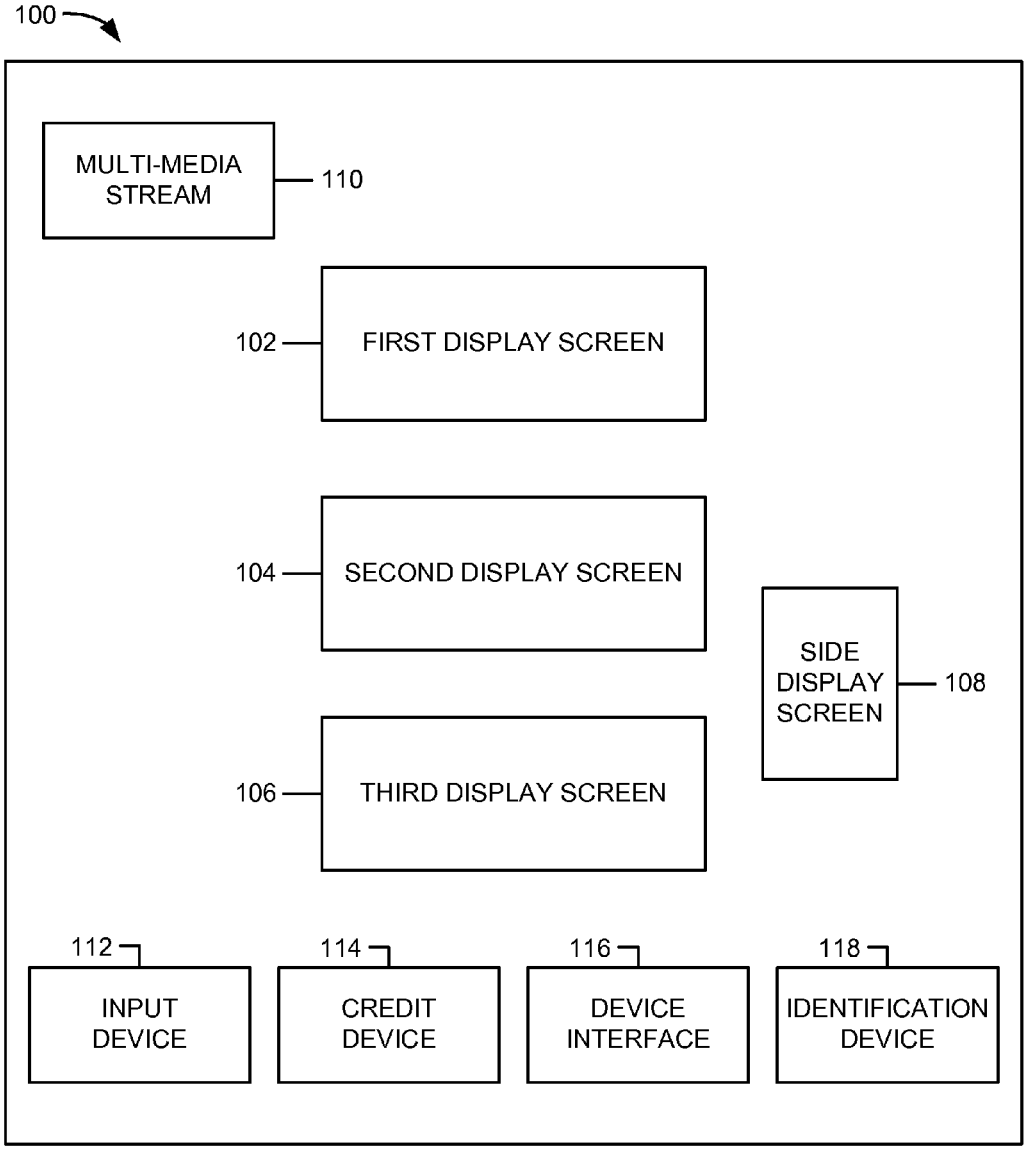
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to control any object (e.g., wheel, virtual wheel, movement of a virtual wheel, movement of a wheel, wheel size, wheel friction, wheel speed, and/or any other wheel characteristic), to select one or more pattern gaming options, to obtain data relating to historical payouts, to select a row and/or column to move, to select a row area to move, to select a column area to move, to select a symbol to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more wheel-based functionalities (e.g., wheel speed, wheel size, wheel location, wheel type game, etc.) may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, a player may want to have game play which has only wheel-based functionality (or similar functionality). Therefore, no games without wheel-based functionality would be presented. In another example, the player may only want to play games that include pattern gaming options only. Therefore, only games which include pattern gaming options would be presented to the player. In another example, the player may only want to play games that include historical information relating to game play. Therefore, only games which include historical gaming data would be presented to the player.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

The presentations associated with wheel-based game play (e.g., one wheel game play, two wheels game play, three wheels game play, nth wheels game play, wheel size, wheel friction based game, etc.) may be presented on one, a few, and/or a plurality of screens. These presentations associated with wheel-based game play may be displayed on a portion of one, a few, and/or a plurality of these screens.

For example, a single large image could be partially displayed on second display screen 104 and partially displayed on third display screen 106, so that when both display screens are put together they complete one image. Electronic gaming device 100 may stream or play prerecorded multi-media data, which may be displayed on any display combination.

Figure 2:
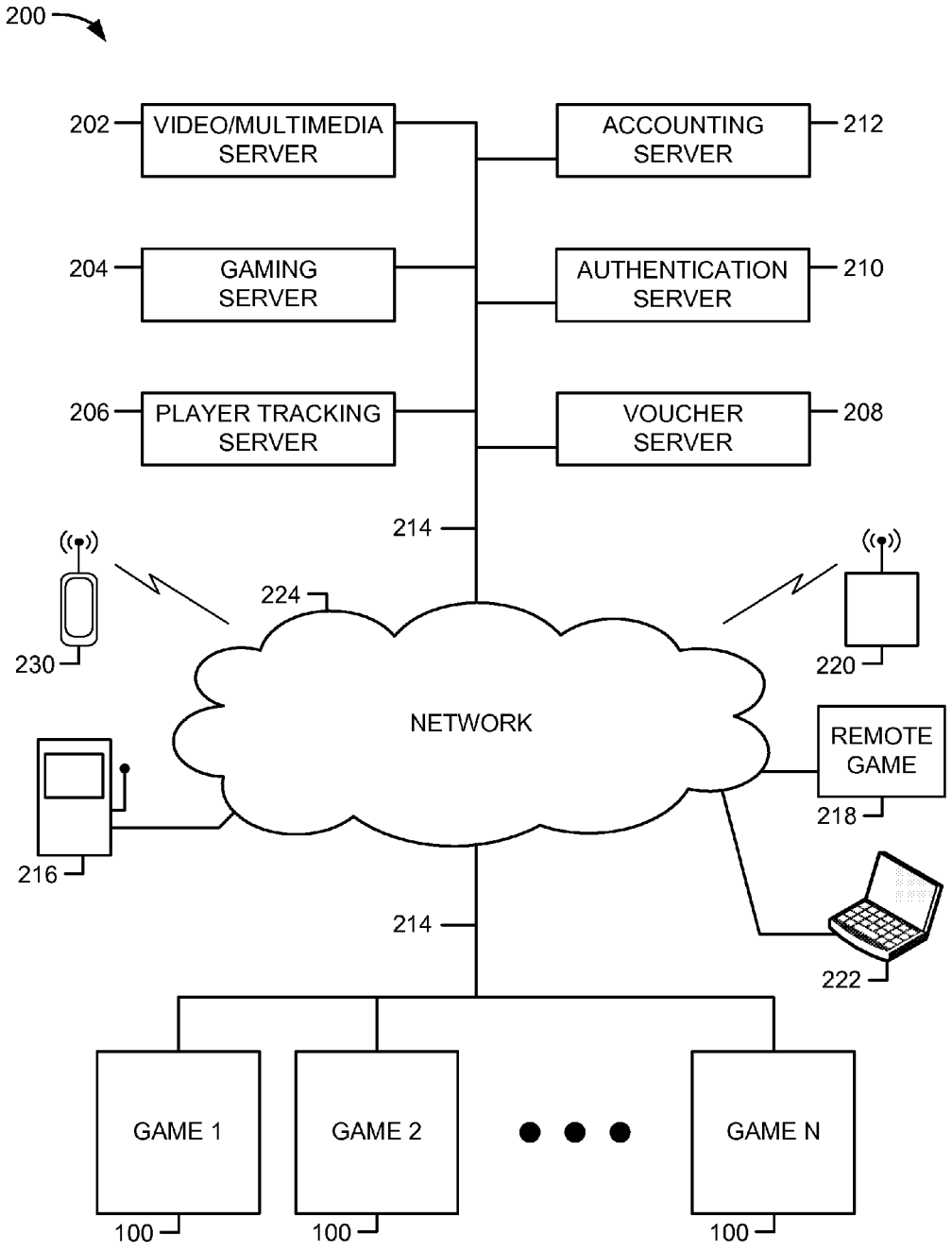
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of a payout functionality, a wheel functionality, a wheel evaluation functionality, other physical game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include wheel-based game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Statistics server may include data relating to one or more wheel-based game play (or similar game play). This data may include the number of time a specific item (e.g., one wheel game play, two wheels game play, nth wheels game play, friction selections, wheel location selections, etc.) was selected. The frequency of any specific item being selected and the amount won. This data may also include data relating to any interrelationship of elements. For example, when two-wheels game play is selected, a friction selection of setting four is selected 35% of the time.

Figure 3:
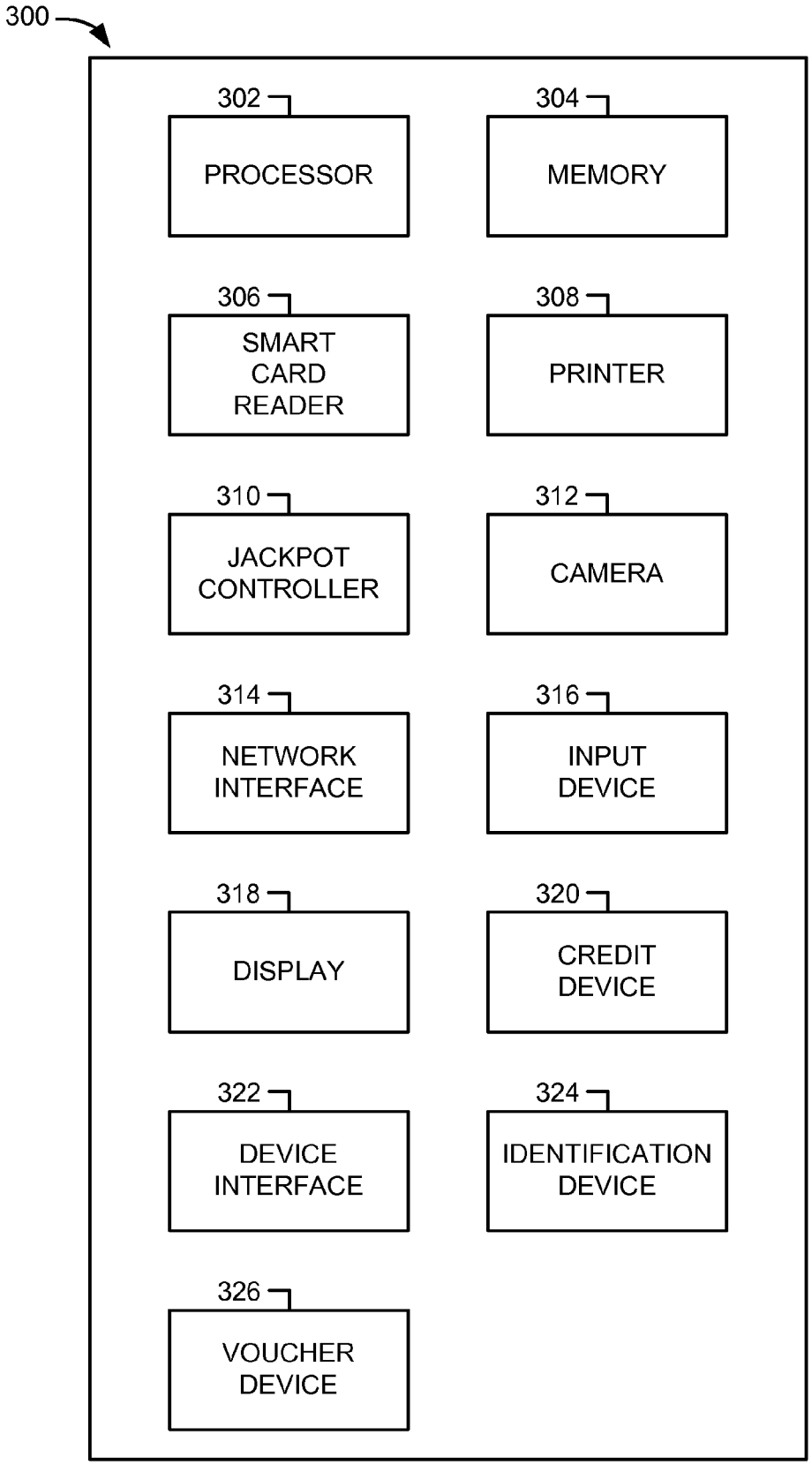
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to select one or more wheel-based gaming options, to make an offer to buy or sell a voucher, to determine a vouchers worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
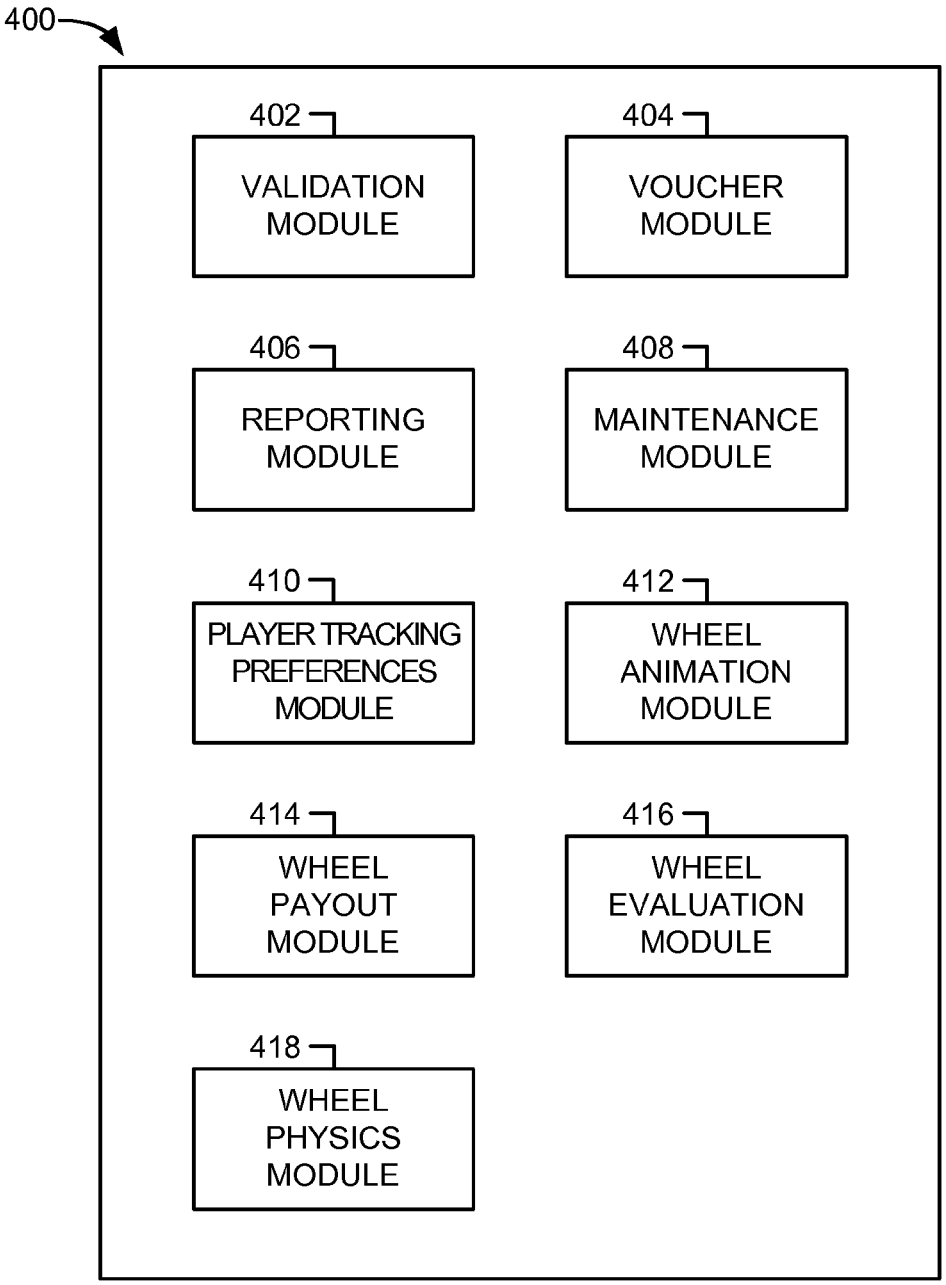
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, a wheel animation module 412, a wheel payout module 414, a wheel evaluation module 416, a wheel physics module 418, a payout module 420, an evaluation module 422, and/or a wheel module 424.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Wheel animation module 412 may generate and display the visual imagery and/or the audio data for one or more wheels (e.g., one or more virtual wheels and/or one or more physical wheels). Wheel animation module 412 may be able to move one or more virtual wheels and/or one or more physical wheels to any spot on gaming device and/or another device.

Wheel payout module 414 may determine and/or display one or more payouts for one or more virtual wheels and/or one or more physical wheels.

Wheel evaluation module 416 may evaluate one or more outcomes for one or more virtual wheels and/or one or more physical wheels.

Wheel physics module 418 may generate and/or determine one or more physical imagery characteristics for one or more virtual wheels. Wheel physics module 418 may generate and/or determine one or more physics-based characteristics for one or more virtual wheels.

Payout module 420 may determine one or more payouts which may not be based on one or more outcomes for one or more virtual wheels and/or one or more physical wheels.

Evaluation module 422 may evaluate one or more outcomes for one or more events which may not be based on one or more outcomes for one or more virtual wheels and/or one or more physical wheels.

Wheel module 424 may include data relating to one or more virtual wheels and/or one or more physical wheels. For example, friction data may be included relating to one or more physical wheels. In another example, virtual friction data may be included relating to one or more virtual wheels. In another example, tilting information (e.g., the ability of the wheel to tilt—shift) may be included relating to one or more virtual wheels and/or one or more physical wheels. In another example, historical data relating to one or more wheels (e.g., virtual and/or physical) may be included. This historical data may include the number of times the wheel has been utilized, win rate, movement history, the theme the wheel is utilized with, etc.

A bonus module may generate a bonus game, evaluate the results of the bonus game, trigger bonus game presentations, generate bonus game payouts, and/or display any data relating to the bonus game.

A presentation generation module may generate the presentation data (e.g., visual and audio) relating to one or more game play options. A presentation module may display one or more of the generated presentations.

It should be noted that one or more modules may be combined into one module. Further, there may be one evaluation module where the determined payout does not depend on whether there were any wild symbols, scatter symbols, wheel play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5:
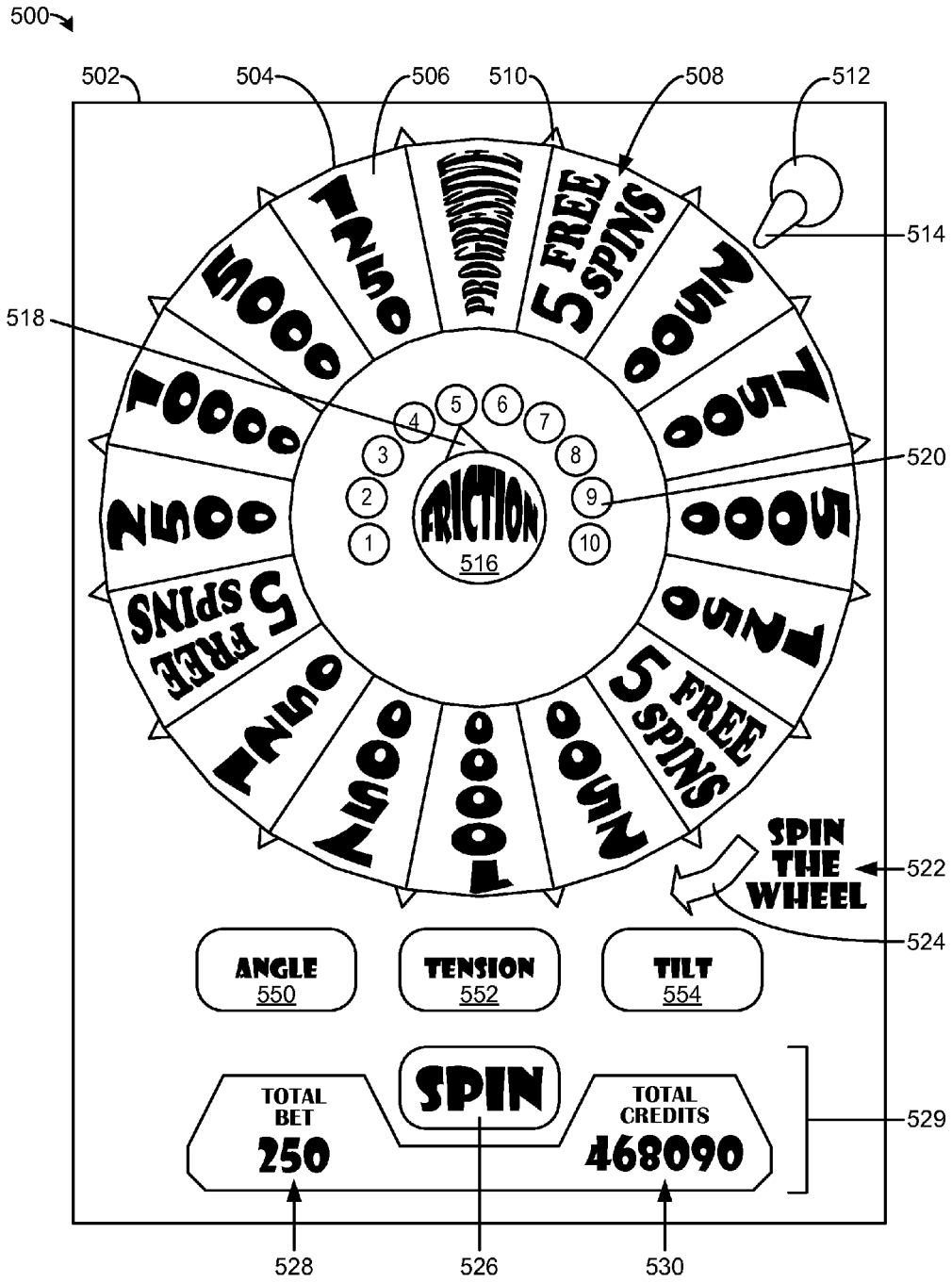
FIG. 5 is an illustration of a wheel-based game play, according to one embodiment.

FIG. 5 is an illustration of a wheel-based game play, according to one embodiment. FIG. 5 shows a screen image 500 for electronic gaming device 100 on display 318. Screen image 500 may include a display area 502, a wheel 504, a message area 522, a knob 512, a pointer 514, an arrow indicator 524, and a game data area 529. Wheel 504, message area 522, knob 512, pointer 514, arrow indicator 524, and/or game data area 529 may be in display area 502 and/or any other display area.

Wheel 504 may be a physical wheel and/or a virtual wheel. Wheel 504 may include a first award area 506, a second award area 508, an award divider 510, a friction controller 516, a friction arrow 518, and one or more friction levels 520. First award area 506 and/or second award area 508 may be included in one or more award areas.

First award area 506 may be a credit amount, a multiplier, free spins, a progressive award, and/or any combination thereof. First award area 506 may be any size.

Second award area 508 may be a credit amount, a multiplier, free spins, a progressive award, and/or any combination thereof. Second award area 508 may be any size. First award area 506 and second award area 508 may be the same size or different sizes. First award area 506 and/or second area 508 may have sizes which vary as the wheel moves. First award area 506 and/or second area 508 may have sizes which do not vary as the wheel moves. First award area 506 and/or second area 508 may have prizes which are hidden until the wheel stops moving. First award area 506 and/or second area 508 may have prizes which are shown.

Award divider 510 may be an indicator which determines where one prize ends (e.g., progressive) and a second prize begins (e.g., 5 free spins).

Friction controller 516 may include friction arrow 518 which may be located in a friction guide (not shown). Friction arrow 518 may indicate a friction setting. In one example, a friction setting of 5 may be indicated by a friction image (e.g., an image of a 5). Any friction amount may be utilized. Friction controller 516 may control the friction effect for one or more wheels (e.g., virtual and/or physical), one or more award areas, a portion of one or more wheels, and/or any other game friction element.

For example, a presentation based on a friction setting of 5 may move slower than a presentation based on a friction setting of 4. In addition, a first friction setting on a first award area may slow down the wheel when the pointer enters it more that when a second friction setting on a second award area.

One or more friction levels 520 may be utilized. One or more friction levels 520 may be any number (e.g., 0 to Nth friction characteristics). In this example, one or more friction levels 520 are from 1 to 10.

Angle controller 550 may include an angle indicator which may be located in an angle guider. Angle indicator may indicate an angle setting. In one example, an angle of 10 degrees may be indicated by an angle image (e.g., an image with the angle indicator pointing to a 10). Any angle may be utilized. Angle controller 550 may control the angle of one or more wheels, one or more award areas, a portion of one or more wheels, and/or any other game play angle.

A tilt controller 554 may include a tilt indicator which may be located in a tilt guider. Tilt indicator may indicate a tilt setting. In one example, a tilt of 4 may be indicated by a tilt image (e.g., an image with the tilt indicator pointing to a 4). Any tilt number (e.g., 1 to Nth) may be utilized. Tilt controller 550 may control the tilting (e.g., tilt function, tilt ability) of one or more wheels, one or more award areas, a portion of one or more wheels, and/or any other game play tilting affect.

Tension controller 552 may include a tension indicator which may be located in a tension guider. Tension indicator may indicate a tension setting. In one example, a tension of 24 may be indicated by a tension image (e.g., an image with a tension indicator pointing to a 24). Any tension number may be utilized. Tension controller 552 may control the tension of one or more wheels, one or more award areas, a portion of one or more wheels, and/or any other game play tension.

Wheel movement button may be utilized to move one or more of a virtual wheel and/or a physical wheel. Wheel may move in any direction (e.g., up, down, right, left, and/or any combination thereof).

Message area 522 may include data relating to game play. For example, message area 522 may include a message stating "SPIN THE WHEEL".

Knob 512 may include pointer 514 which indicates which prize would be rewarded when the wheel stops. For example, if the wheel stopped in the position indicated by FIG. 5, the prize of 2,500 credits would be a winning award.

Arrow indicator 524 indicates which direction the wheel is spinning and/or which direction the wheel may be spun in. A wheel may be spun to the right (e.g., clockwise), the left (e.g., counter clockwise), and/or both directions.

Display area 502 may be utilized to display any wheel-based gaming functionality (e.g., wheel speed, wheel friction, wheel tension, wheel angle, wheel size, wheel location, the number of wheels, and/or other similar functionality).

In one embodiment, a player, electronic gaming device 100, and/or electronic gaming system 200 may select one or more wheel-based gaming functionality (e.g., wheel speed, wheel friction, wheel tension, wheel angle, wheel size, wheel location, the number of wheels, and/or other similar functionality).

The wheel-based gaming functionality may include a multi-level selection option. A multi-level item picking option may be utilized. In one example, if the wheel stops on a multi-level picking item, then the player may have the option to select one or more of multi-level selection options. In this example, if wheel stops on an item with a multi-level selection characteristic, the system and/or method may display three images which may be selected by the player. In this example, the three images may reveal prizes of 1,000, 2,000, and 5,000 credits, respectively. Therefore, depending on which multi-level options is selected; the player may win 1,000 credits, 2,000 credits, or 5,000 credits. Any number of multi-level items may be utilized, along with any number of selections.

In various examples, the player, electronic gaming device 100, and/or electronic gaming system 200 may select from 1 through $n^{th}$ of the picking objects available for selection. Any number of picking objects, characters, weapons, objects, obstacles, and/or selections may be utilized.

One or more of the picking objects may be a stopper, which may end game play. It should be noted that the objects may be any item (e.g., a person, a weapon, a structure, an animal, a vehicle, a tool, an instrument, a natural feature (e.g., hill, mountain, lake, sea, etc.), a machine, and/or any other item).

Game data area 529 may include additional data relating to the games. For example, a game menu, a bet amount, a winning total, a credit total, a betting increment (e.g., $0.01 per credit), an input button (e.g., move an object (e.g., wheel, virtual wheel, etc.) select, play, deal, draw, shot, etc.), and/or any other gaming data may be shown.

Game menu button may include data relating to the game. For example, the payout structures, payout odds, the amount won over a predetermined number of game plays, the amount won over a specific time frame, and/or any other game play data may be accessed via game menu button. Game menu button may be utilized to change the game from a first game (e.g., slot machine theme 1) to a second game (e.g., slot machine theme 2, poker, blackjack, roulette, baccarat, craps, etc.). Game menu button may be utilized to change any other game structure (e.g., credit amounts). For example, the credit amount may be increased/decreased between $0.01 to $1.00 and/or any other values.

A bet reducer button (e.g., a downward arrow) may decrease the amount of credits wagered on game play. A bet amount image (e.g., 250) may show the amount of credits wagered on game play. A bet increaser button (e.g., an upward arrow) may increase the amount of credits wagered on game play. A credit amount image (e.g., 207,085) may show the amount of credits available to the player for game play. A win amount area (e.g., 1,000) may show the payout amount of the last event. A credit value image (e.g., $0.01) may show the value of a single credit. A play button may start the next game. A message area may display any message to the player. For example, the message may state "You Won 1,000 Credits. Congratulations!!!!!".

A fast play button may be utilized to speed up the game, automate the game (e.g., electronic gaming device 100 and/or electronic gaming system 200 selects the object), and/or reduce the presentations.

Game data area 529 may include a betting area 528, a play button 526, and/or a total credits area 530. Betting area 528 may show the amount of a bet. Play button 526 (e.g., spin) may initiate game play. Total credits area 530 may show a player's credit balance.

Figure 6A:
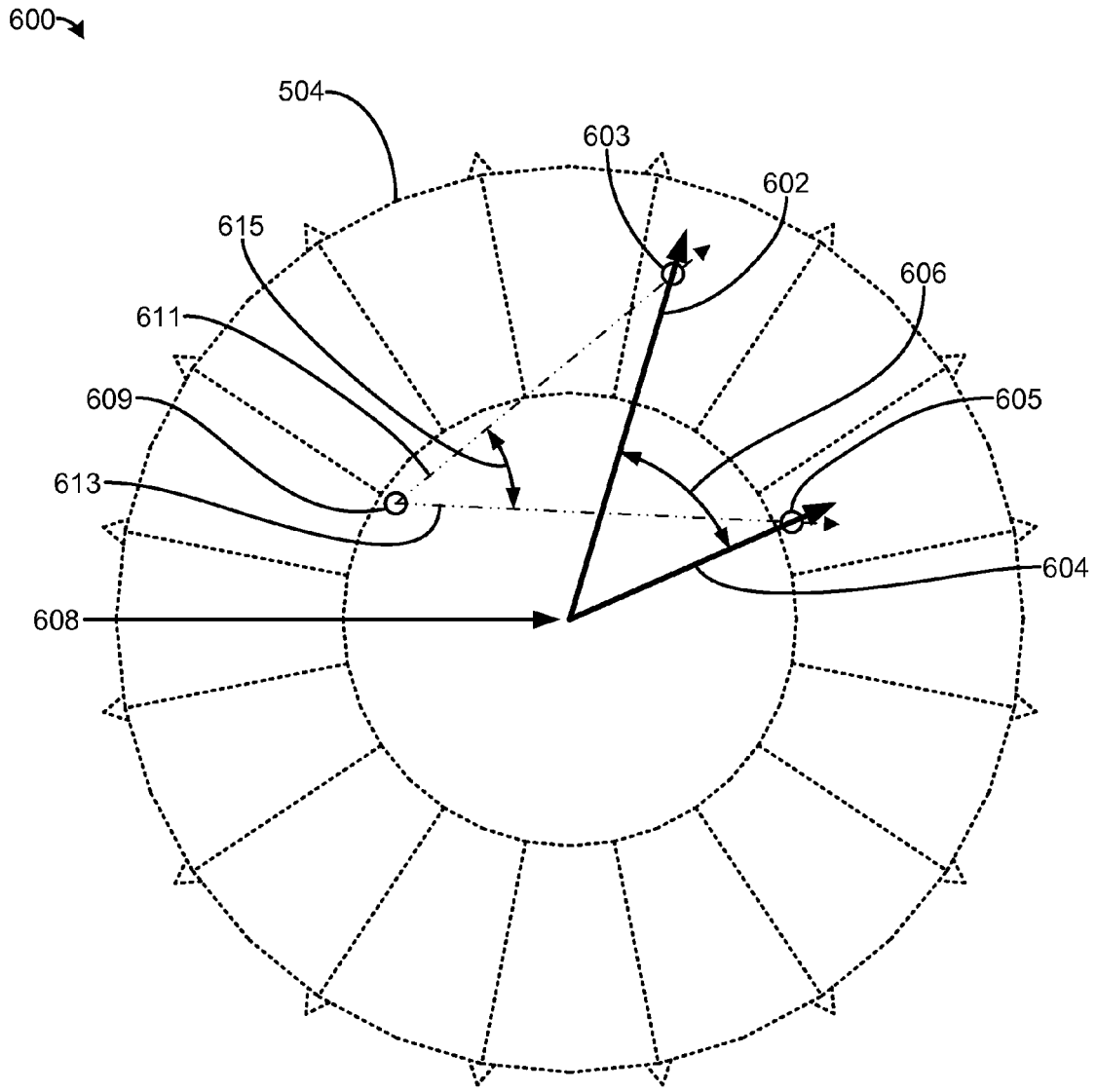
FIG. 6A is another illustration of a wheel-based game play, according to one embodiment.

FIG. 6A is another illustration of a wheel-based game play, according to one embodiment. A second image 600 may include wheel 504, a first vector 602, a second vector 604, a first angle 606, and a center point 608.

First vector 602 may be a first vector determined by center point 608 and a first position 603. First position 603 may be a position where an initial launch point is determined. Second vector 604 may be a second vector determined by center point 608 and a second position 605. Second position 605 may be a position where a final launch point is determined. First angle 606 may be an angle created between first vector 602 and second vector 604.

In one example, the characteristics of wheel 504 may be determined based on one or more of first vector 602, second vector 604, and/or first angle 606.

In one example, if first angle 606 is 5 degrees, then wheel 504 may move at a first speed (e.g., very slow). In another example, if first angle 606 is 15 degrees, then wheel 504 may move at a second speed (e.g., slow). In another example, if first angle 606 is 40 degrees, then wheel 504 may move at a third speed (e.g., average). In another example, if first angle 606 is 80 degrees, then wheel 504 may move at a fourth speed (e.g., fast). In another example, if first angle 606 is 110 degrees, then wheel 504 may move at a fifth speed (e.g., very fast). Any speed (e.g., one revolution per millisecond to one revolution per minute) may be utilized.

In one example, if first angle 606 is 10 degrees, then wheel 504 may have a varying size affect. In another example, if first angle 606 is 25 degrees, then wheel 504 may have a slight tilting affect. In another example, if first angle 606 is 55 degrees, then wheel 504 may have a vibrating affect. In another example, if first angle 606 is 80 degrees, then wheel 504 may have a fire affect. In another example, if first angle 606 is 110 degrees, then wheel 504 may have a blurring affect. Any speed (e.g., one revolution per nanosecond to one revolution per hour) may be utilized.

In one example, if first vector 602 has a length of 1 inch and second vector 604 has a length of less than 1 inch, then wheel 504 may move at a first speed (e.g., very slow). In another example, if first vector 602 has a length of 2 inches and second vector 604 has a length of less than 2 inches, then wheel 504 may move at a second speed (e.g., slow). In another example, if first vector 602 has a length of 3 inches and second vector 604 has a length of less than 3 inches, then wheel 504 may move at a third speed (e.g., average). In another example, if first vector 602 has a length of 4 inches and second vector 604 has a length of less than 4 inches, then wheel 504 may move at a fourth speed (e.g., fast). In another example, if first vector 602 has a length of 6 inches and second vector 604 has a length of less than 6 inches, then wheel 504 may move at a fifth speed (e.g., very fast). Any speed (e.g., one revolution per millisecond to one revolution per minute) may be utilized.

In one example, if first vector 602 has a length of 1 inch and second vector 604 has a length of less than 1 inch, then wheel 504 may have a varying size affect. In another example, if first vector 602 has a length of 2 inches and second vector 604 has a length of less than 2 inches, then wheel 504 may have a slight tilting affect. In another example, if first vector 602 has a length of 3 inches and second vector 604 has a length of less than 3 inches, then wheel 504 may have a vibrating affect. In another example, if first vector 602 has a length of 4 inches and second vector 604 has a length of less than 4 inches, then wheel 504 may have a fire affect. In another example, if first vector 602 has a length of 6 inches and second vector 604 has a length of less than 6 inches, then wheel 504 may have a blurring affect.

In one example, if first vector 602 has a length of 2 inches or less and second vector 604 has a length of less than 5 inches or less, then wheel 504 may move at a first speed (e.g., very slow). In another example, if first vector 602 has a length of 5 inches or less and second vector 604 has a length of greater than 2 inches but less than 5 inches, then wheel 504 may move at a second speed (e.g., slow). In another example, if first vector 602 has a length of between 5 inches and 7 inches and second vector 604 has a length of greater than 3 inches but less than 6 inches, then wheel 504 may move at a third speed (e.g., average). In another example, if first vector 602 has a length of between 6 inches and 10 inches and second vector 604 has a length of more than 4 inches, then wheel 504 may move at a fourth speed (e.g., fast). In another example, if first vector 602 has a length of 10 inches or more and second vector 604 has a length of more than 2 inches, then wheel 504 may move at a fifth speed (e.g., very fast). Any speed (e.g., one revolution per millisecond to one revolution per minute) may be utilized.

In one example, if first vector 602 has a length of 2 inches or less and second vector 604 has a length of less than 5 inches or less and first angle 606 is less than 30 degrees, then wheel 504 may move at a first speed (e.g., very slow). In another example, if first vector 602 has a length of 5 inches or less and second vector 604 has a length of greater than 2 inches but less than 5 inches and first angle 606 is at least 31 degrees, then wheel 504 may move at a second speed (e.g., slow). In another example, if first vector 602 has a length of between 5 inches and 7 inches and second vector 604 has a length of greater than 3 inches but less than 6 inches and first angle 606 is at least 70 degrees, then wheel 504 may move at a third speed (e.g., average). In another example, if first vector 602 has a length of between 6 inches and 10 inches and second vector 604 has a length of more than 4 inches and first angle is between 70 degrees and 110 degrees, then wheel 504 may move at a fourth speed (e.g., fast). In another example, if first vector 602 has a length of 10 inches or more and second vector 604 has a length of more than 2 inches and first angle is at least 140 degrees, then wheel 504 may move at a fifth speed (e.g., very fast). Any speed (e.g., one revolution per millisecond to one revolution per minute) may be utilized.

Center point 608 may be a position which is located at the center of the wheel. Center point 608 may be shifted to any location on wheel 504. For example, a shifted center point 609 may generate a third vector 611, a fourth vector 613, and a second angle 615 based on first position 603 and second position 605. In one example, the characteristics of wheel 504 may be determined based on one or more of third vector 611, fourth vector 613, and/or second angle 615.

The player, electronic gaming device 100, and/or electronic gaming system 200 may generate various positional data utilized to move one or more wheels. For example, a player may place their finger on a touch screen to generate a first positional data. As the player continues to move their finger across the touch screen various positional data may be generated. Once the player's finger leaves the touch screen a final positional data (e.g., launch data) may be generated. This final positional data may be utilized to generate second vector 604. Further, first vector 602 may be generated based on another positional data. This other positional data may be some distance (and/or time period) before final positional data. Therefore, once the final positional data is known the other positional data utilized to generate first vector 602 may be generated. For example, the system and/or method may utilize the positional data that is 10 data points (or 1, 2, 3 nth) before final positional data to generate first vector 602. In another example, the system and/or method may utilize the positional data that was generated 2 milliseconds before final positional data to generate first vector 602. Any distance, angle, speed, acceleration, velocity, time, any other criteria, and/or any combination thereof may be utilized.

In addition, any sampling rate may be utilized. Further, a dot product may be utilized. Any angle distance in time calculation may be utilized. Any time based sampling may be utilized. Any calculated angle (e.g., arc cosine) may be utilized. In addition, angular velocity and/or angular acceleration may be utilized. Further, inertia data, mass, torque, and/or angular momentum may be utilized.

In one example, a dot product based on an arc cosine of the angle between two vectors may be utilized. In another example, only the last two sample points may be utilized. In another example, two or more of the positional points may be utilized. In another example, a starting velocity (or other starting data) may be utilized. In another example, an ending velocity (or other ending data) may be utilized. In another example, a few points around the starting velocity (or other starting data) may be utilized. In another example, a few points around the ending velocity (or other ending data) may be utilized.

The player may utilize a touch screen and/or a spin button to move one or more wheels.

Figure 6B:
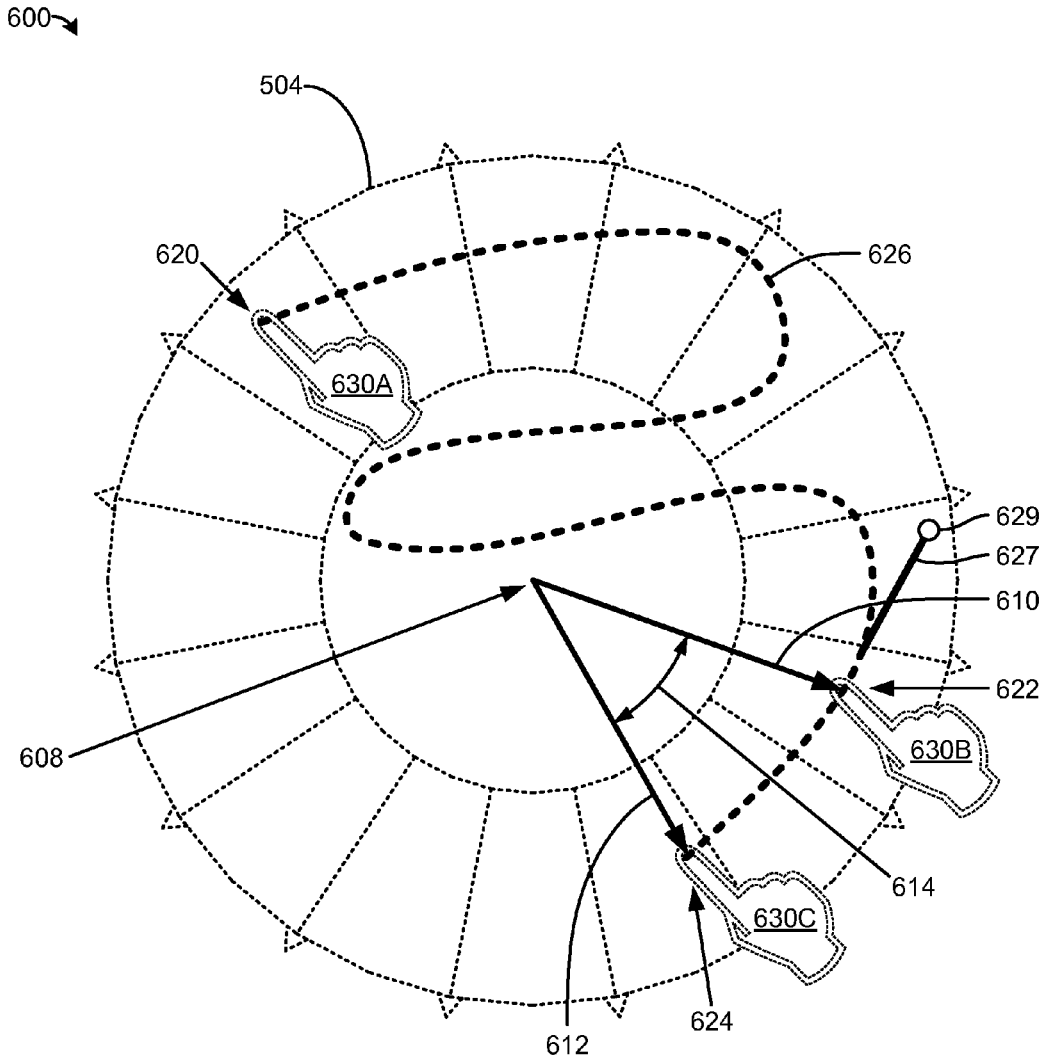
FIG. 6B is another illustration of a wheel-based game play, according to one embodiment.

FIG. 6B shows another wheel-based game play, according to one embodiment. In this example, second image 600 may include wheel 504, a first path 626, and a second path 627. First path 626 may have a first point 620, a second point 622, and a third point 624. Second path 627 may have a fourth point 629, second point 622, and third point 624. In one example, the characteristics (e.g., speed, angle, tilt, etc.) of wheel 504 would be identical for both first path 626 and second path 627 because the launching point (e.g., third point 624) and a predetermined point before launching point (e.g., second point 622) are the same.

First point 620 may be the point which is initially touched by the player. Second point 622 may be the point which is a certain criteria (e.g., time, distance, etc.) before third point 624. Third point 624 may be the last point (e.g., launch point) touched by the player. A fifth vector 610 may be formed based on second point 622 and center point 608. A sixth vector 612 may be formed based on third point 624 and center point 608. A third angle 614 may be formed between fifth vector 610 and sixth vector 612.

The wheel bonus game may use a virtual representation of a spinning wheel. The wheel may have the characteristics of a physics based wheel simulation including velocity and friction. When the player touches the wheel a calculation may be completed between the locations of their finger on screen from frame-to-frame. The calculation may track velocity in a purely rotation context. The calculation may determine the number of degrees rotated around the center of the wheel instead of in a linear direction. The wheel may follow the player's finger until released with a given minimum velocity applied to the wheel. Once the wheel is spinning at a minimum velocity, it may no longer respond to the player's touch.

At this stage the wheel may spin with the velocity inputted by the player, but left to its own devices will stop at a location different from what the math simulation has determined. In order to get the wheel to stop at a desired location the wheel may coast with no friction applied until a given point where applying friction at a constant rate may make the wheel stop at the desired location. In one example, the expected rotation of the wheel may be calculated at the time the player releases (e.g., launch point) but before any friction is applied. The calculation may then subtract the expected rotation from the desired stop rotation as determined by the location of displayed numbers on the wheel. The calculated difference may be the amount of distance the wheel may coast. Once the coast distance has been covered, the system and/or method may apply friction again and the wheel may stop at the desired location.

In one embodiment, wheel 504 may move based on one or more player inputs (e.g., touching the screen) and may have stopped at a location other than the location of the calculated winning event. Therefore, the system and/or method may allow wheel 504 to spin until a specific point where applying a friction force may stop wheel 504 with a presentation affect that appears to be based on a normal (e.g., not jerky) spinning rotation.

Figure 7A:
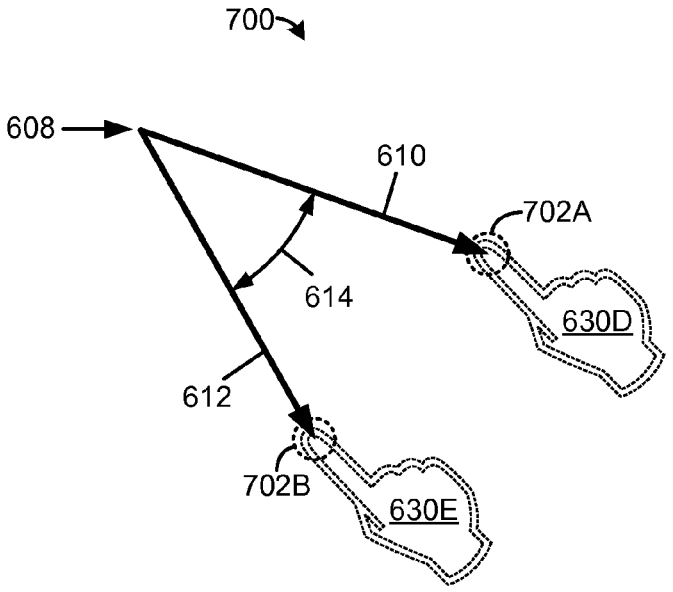
FIG. 7A is another illustration of a wheel-based game play, according to one embodiment.

FIG. 7A shows another wheel-based game play, according to one embodiment. In this example, a third image 700 may include fifth vector 610, sixth vector 612, and third angle 614. A player may utilize one finger (e.g., 630D and 630E) to generate a first touch point 702A and a second touch point 702B. The movement of the wheel (or more than one wheels) may be based on the vectors (e.g., fifth vector 610 and sixth vector 612) generated by first touch point 702A and second touch point 702B, along with the areas created by the player utilizing one finger to generate first touch point 702A and second touch point 702B. For example, the characteristics (e.g., speed, angle, tilt, etc.) of wheel 504 may be based on an area generated by utilizing one finger. In this case, the wheel may travel at a first speed based on a player's utilization of one finger. In one example, the greater the area generated the faster wheel 504 would spin.

Figure 7B:
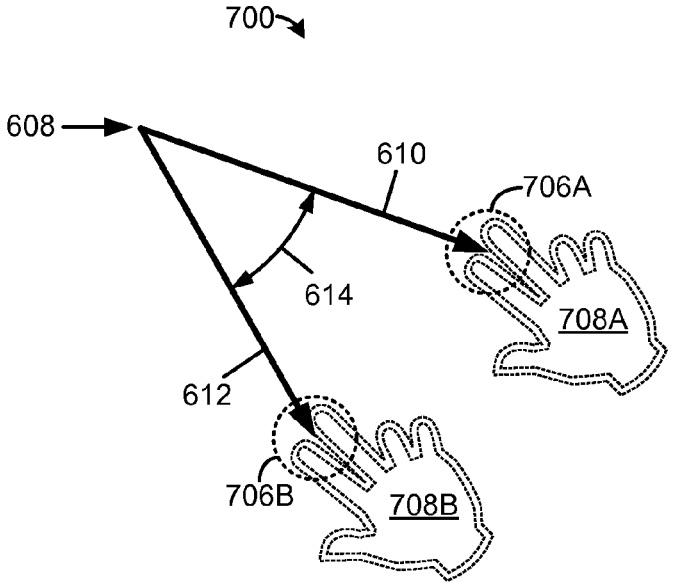
FIG. 7B is another illustration of a wheel-based game play, according to one embodiment.

FIG. 7B shows another wheel-based game play, according to one embodiment. In this example, third image 700 may include fifth vector 610, sixth vector 612, and third angle 614. A player may utilize two fingers (e.g., 708A and 708B) to generate a third touch point 706A and a fourth touch point 706B. The movement of the wheel (or more than one wheels) may be based on the vectors (e.g., fifth vector 610 and sixth vector 612) generated by third touch point 706A and fourth touch point 706B, along with the areas created by the player utilizing two fingers to generate third touch point 706A and fourth touch point 706B. For example, the characteristics (e.g., speed, angle, tilt, etc.) of wheel 504 may be based on an area generated by utilizing two fingers. In this case, the wheel may travel at a second speed based on a player's utilization of two fingers. Second speed may be faster than the first speed generated by utilizing one finger.

Figure 7C:
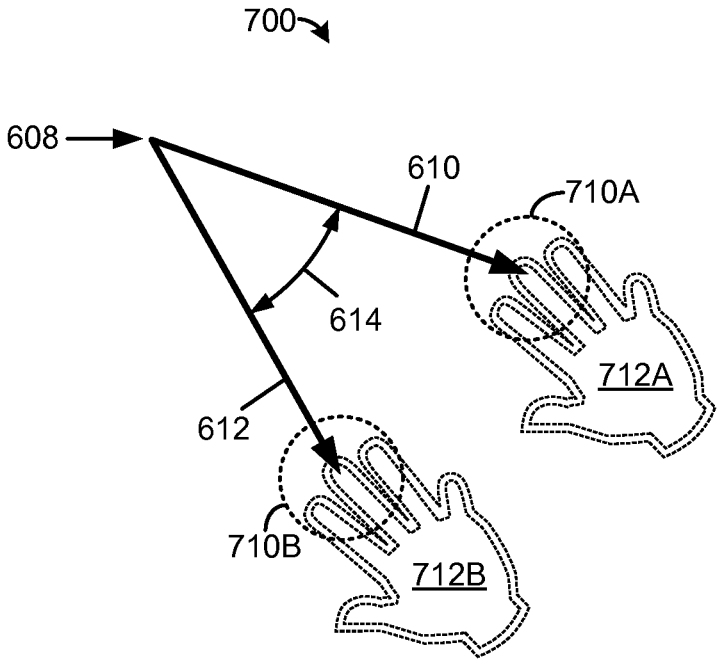
FIG. 7C is another illustration of a wheel-based game play, according to one embodiment.

FIG. 7C is an illustration of a wheel-based game play, according to one embodiment. In this example, third image 700 may include fifth vector 610, sixth vector 612, and third angle 614. A player may utilize three fingers (e.g., 712A and 712B) to generate a fifth touch point 710A and a sixth touch point 710B. The movement of the wheel (or more than one wheels) may be based on the vectors (e.g., fifth vector 610 and sixth vector 612) generated by fifth touch point 710A and sixth touch point 710B, along with the areas created by the player utilizing three fingers to generate fifth touch point 710A and sixth touch point 710B. For example, the characteristics (e.g., speed, angle, tilt, etc.) of wheel 504 may be based on an area generated by utilizing third fingers. In this case, the wheel may travel at a third speed based on a player's utilization of three fingers. The third speed may be faster than the second speed.

Figure 8A:
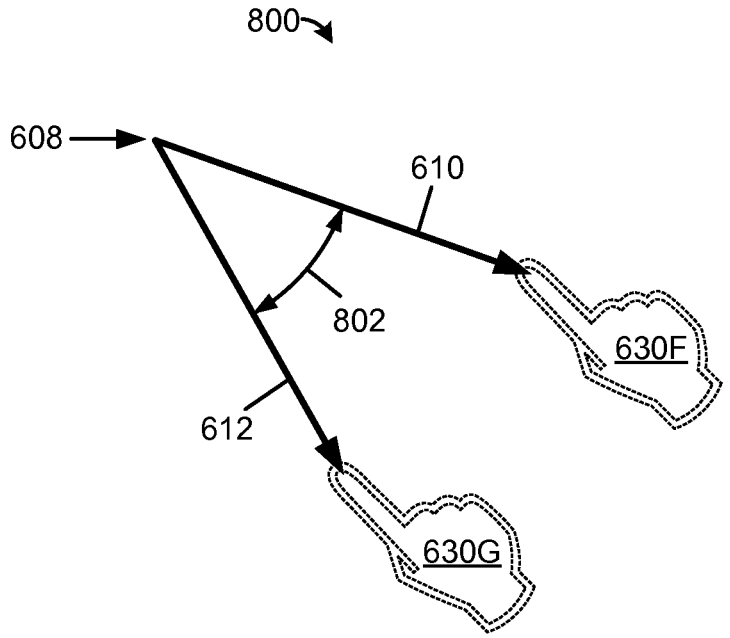
FIG. 8A is another illustration of a wheel-based game play, according to one embodiment.

FIG. 8A is an illustration of a wheel-based game play, according to one embodiment. In this example, a fourth image 800 may include fifth vector 610, sixth vector 612, and a fourth angle 802. Fourth angle 802 may indicate that the distance between a first point 630F and a second point 630G is a first distance. The wheel movement (e.g., any wheel characteristic) may be based on fifth vector 610, sixth vector 612, and fourth angle 802. Therefore, the wheel movement (e.g., any wheel characteristic) may be based on the first distance.

Figure 8B:
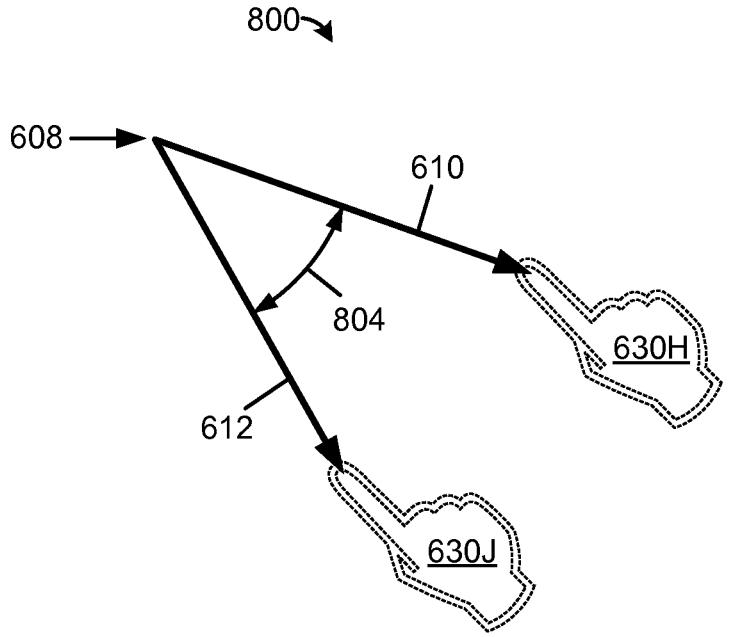
FIG. 8B is another illustration of a wheel-based game play, according to one embodiment.

FIG. 8B is an illustration of a wheel-based game play, according to one embodiment. In this example, fourth image 800 may include fifth vector 610, sixth vector 612, and a fifth angle 804. Fifth angle 804 may indicate that the distance between a third point 630H and a fourth point 630J is a second distance. The wheel movement (e.g., any wheel characteristic) may be based on fifth vector 610, sixth vector 612, and fifth angle 804. Therefore, the wheel movement (e.g., any wheel characteristic) may be based on the second distance.

One or more characteristics (e.g., speed, angle, tilt, etc.) may be based on distance. For example, wheel 504 may move at a first speed based on the first distance. In another example, wheel 504 may move at a second speed based on the second distance. The second speed may be faster than the first speed because the second distance is greater than the first distance.

Figure 9A:
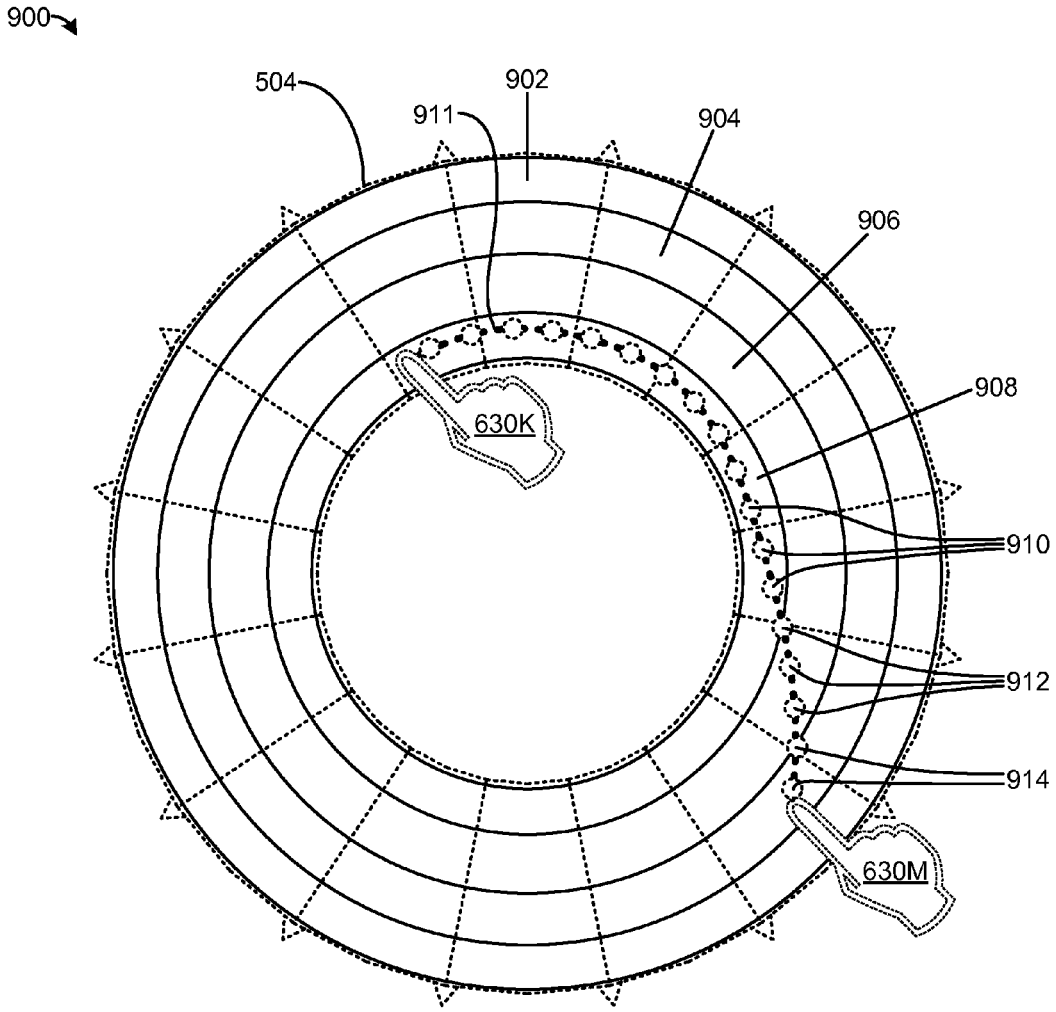
FIG. 9A is another illustration of a wheel-based game play, according to one embodiment.

FIG. 9A is an illustration of a wheel-based game play, according to one embodiment. In this example, a fifth image 900 may include wheel 504. Wheel 504 may include a first ring 902, a second ring 904, a third ring 906, and a fourth ring 908. A player may start at a fifth point 630K within fourth ring 908 and end at a sixth point 630M to generate a first pathway 911. The player may provide movement data (e.g., move their hand, finger, etc.) which indicates that first pathway 911 has moved from fourth ring 908 to third ring 908 to second ring 904. In this example, a first set of points 910 may indicate a first movement pattern from the inner section of fourth ring 908 to the outer section of fourth ring 908 on first pathway 911. A second set of points 912 may indicate a second movement pattern from the outer section of fourth ring 908 to the outer section of third ring 906 via the inner section of third ring 906 on first pathway 911. A third set of points 914 may indicate a third movement pattern from outer section of third ring 906 to the middle section of second ring 904 via the inner section of second ring 904 on first pathway 911.

Wheel characteristics (e.g., speed, direction, tilt, audio presentations, visual presentations, etc.) may be based on a last ring utilized by a pathway, how many rings where utilized by a pathway, the starting ring and the ending ring of the pathway, the time required to complete the pathway, the distance of the pathway, the angles utilized on the pathway, the average speed utilized on the pathway, the highest speed utilized on the pathway, the number of contact points on the pathway, the width of the pathway, the tilt factor for each ring, any changes in direction, and/or any combination thereof.

For example, a tilting feature may depend on which ring was the last ring utilized by a pathway. In one example, fourth ring 908 which is closest to the center of the wheel may generate the lowest tilting feature and/or no tilting feature. In another example, first ring 902 which is the farthest from the center of the wheel may generate the greatest tilting feature. In another example, second ring 904 may generate the second highest tilting feature because second ring 904 is the second farthest from the center of the wheel. In another example, third ring 906 may generate the second lowest tilting feature because third ring 906 is the second closest from the center of the wheel.

For example, the number of rings utilized by a pathway may partially determine a speed (and/or any other wheel characteristic) of wheel 504. In one example, if four rings are utilized, then a first speed (e.g., highest) may be employed. In another example, if only one ring is utilized, then a second speed (e.g., lowest) may be employed.

For example, one or more wheel characteristics may be determined based on which ring was the starting ring and which ring was the ending ring for the pathway. In one example, when the pathway goes through fourth ring 908 and third ring 906 a first characteristic may be utilized. Whereas, when the pathway goes through fourth ring 908, third ring 906, and second ring 904 a second characteristic may be utilized. In addition, when the pathway goes through third ring 906 and second ring 904 a third characteristic may be utilized.

For example, if the pathway is completed in a first time, then a four characteristic may be utilized. Whereas, if the pathway is completed in a second time, then a fifth characteristic may be utilized.

For example, if the pathway is completed in a first distance, then a sixth characteristic may be utilized. Whereas, if the pathway is completed in a second distance, then a seventh characteristic may be utilized.

For example, if the pathway is completed using a first angle, then an eighth characteristic may be utilized. Whereas, if the pathway is completed using a second angle, then a ninth characteristic may be utilized.

For example, if the pathway is completed with a first speed, then a tenth characteristic may be utilized. Whereas, if the pathway is completed with a second speed, then an eleventh characteristic may be utilized.

For example, if the pathway is completed with a first highest speed, then a twelve characteristic may be utilized. Whereas, if the pathway is completed with a second highest speed, then a thirteenth characteristic may be utilized.

For example, if the pathway is completed with a first number of contact points, then a fourteenth characteristic may be utilized. Whereas, if the pathway is completed with a second number of contact points, then a fifteenth characteristic may be utilized.

For example, if the pathway is completed with a first width, then a sixteenth characteristic may be utilized. Whereas, if the pathway is completed with a second width, then a seventeenth characteristic may be utilized.

For example, if the pathway is completed with a first tilting factor for each ring, then an eighteenth characteristic may be utilized. Whereas, if the pathway is completed with a second titling factor for each ring, then a nineteenth characteristic may be utilized.

For example, if the pathway is completed with a first number of directional changes, then a twentieth characteristic may be utilized. Whereas, if the pathway is completed with a second number of directional changes, then a twenty-first characteristic may be utilized.

Figure 9B:
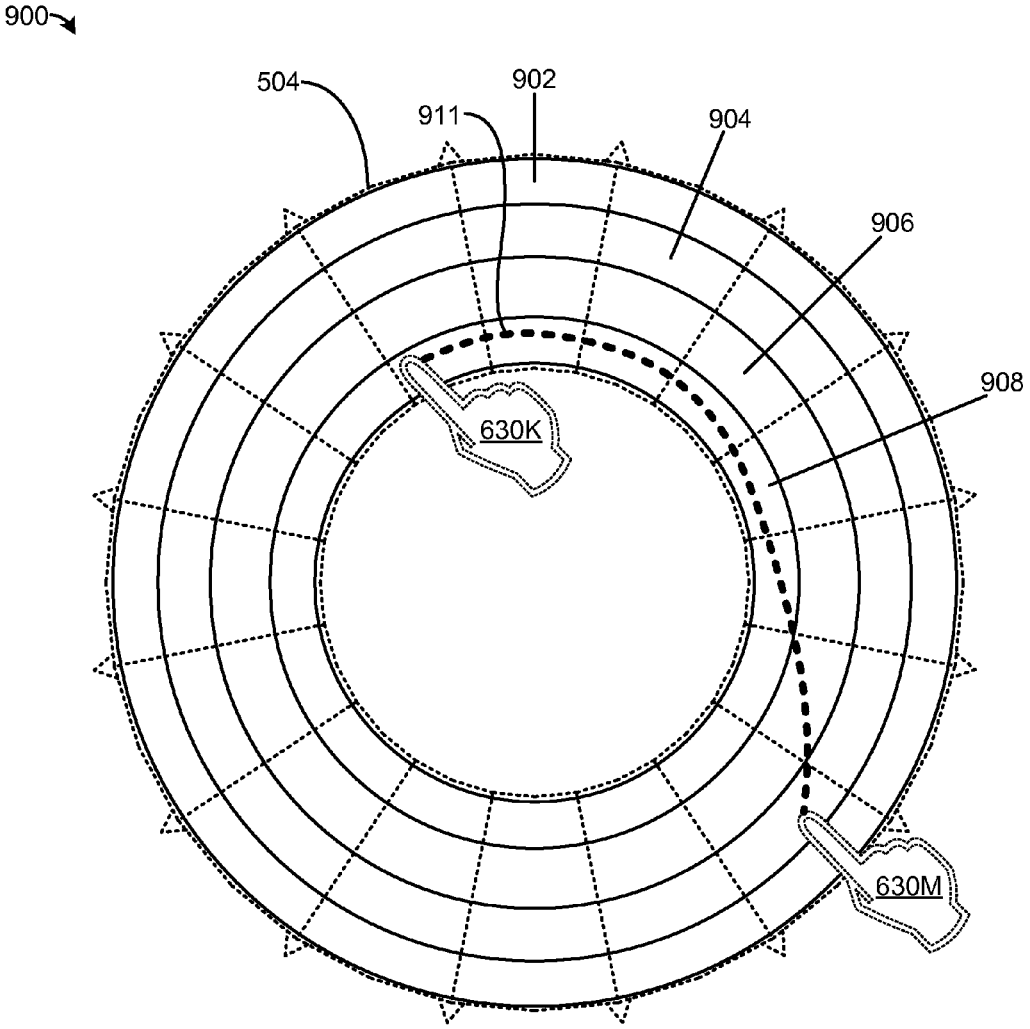
FIG. 9B is another illustration of a wheel-based game play, according to one embodiment.

FIG. 9B is an illustration of a wheel-based game play, according to one embodiment. In this example, a player has provided movement data from fifth point 630K within fourth ring 908 and end at sixth point 630M to generate first pathway 911. In this example, wheel 504 may spin clockwise. Further, wheel 504 may move at a third speed because first pathway 911 traveled through three rings (e.g., second ring 904, third ring 906, and fourth ring 908). Wheel 504 may move at a fourth speed when first pathway 911 travels through four rings (e.g., first ring 902, second ring 904, third ring 906, and fourth ring 908). Wheel 504 may move at a second speed when first pathway 911 travels through two rings (e.g., third ring 906 and fourth ring 908). Wheel 504 may move at a first speed when first pathway 911 travels through one ring (e.g., fourth ring 908).

Any combinations of rings may be utilized. For example, wheel 504 may move at a first speed when first pathway 911 travels through one ring (e.g., first ring 902, second ring 904, third ring 906, or fourth ring 908). In another example, wheel 504 may move at a second speed when first pathway 911 travels through two rings (e.g., any two of first ring 902, second ring 904, third ring 906, or fourth ring 908). In another example, wheel 504 may move at a third speed because first pathway 911 traveled through three rings (e.g., any three of first ring 902, second ring 904, third ring 906, or fourth ring 908).

Figure 10A:
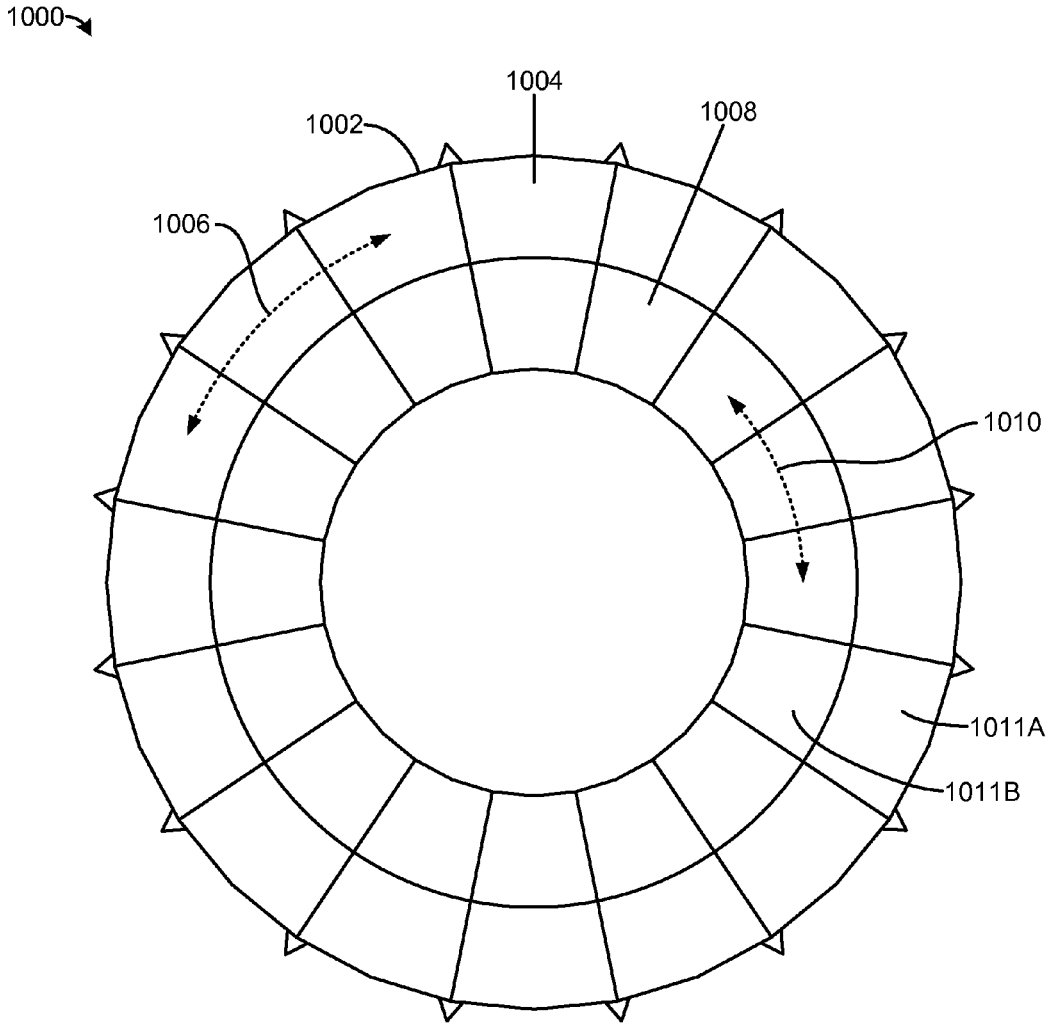
FIG. 10A is another illustration of a wheel-based game play, according to one embodiment.

FIG. 10A is an illustration of a wheel-based game play, according to one embodiment. In this example, a sixth image 1000 may include a multi-spin wheel 1002. Multi-spin wheel 1002 may include a first wheel 1004 and a second wheel 1008. First wheel 1004 and second wheel 1008 may spin in any direction as indicated by a first movement arrow 1006 and a second movement arrow 1010. First wheel 1004 and second wheel 1008 may include one or more award areas (e.g., 1011A, 1011B, etc.).

Figure 10B:
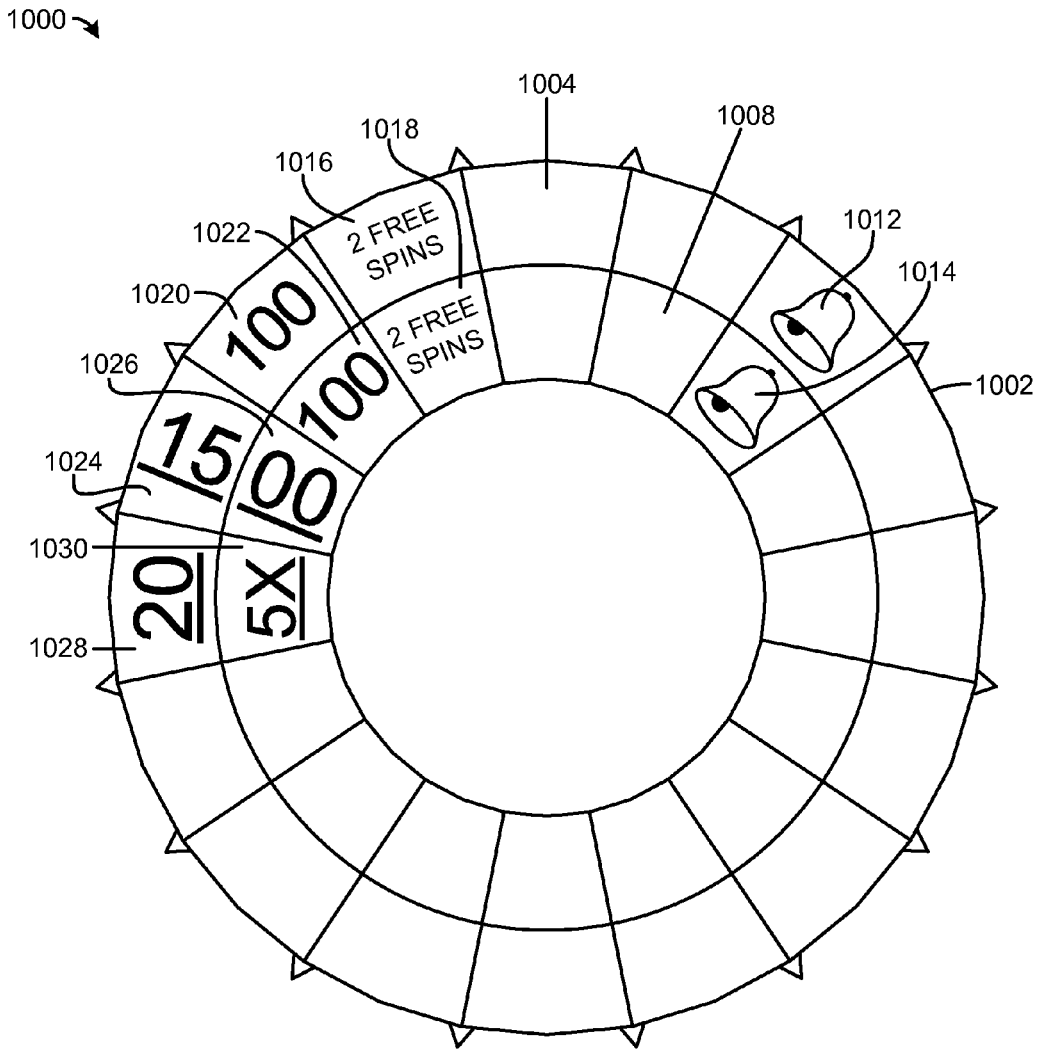
FIG. 10B is another illustration of a wheel-based game play, according to one embodiment.

FIG. 10B is an illustration of a wheel-based game play, according to one embodiment. In this example, a player, electronic gaming device 100, and/or electronic gaming system 200 may provide movement data for first wheel 1004 which may allow first wheel 1004 to stop in a first position. The player, electronic gaming device 100, and/or electronic gaming system 200 may provide movement data for second wheel 1008 which may allow second wheel 1008 to stop in a second position. If one or more symbols on first wheel 1004 match up with one or more symbols on second wheel 1008, one or more awards are generated. For example, if a first bell symbol 1012 on first wheel 1004 is aligned with a second bell symbol 1014 on second wheel 1008, one or more awards (e.g., credits, multipliers, free spins, progressives, any bonus games, and/or any other item of value) may be generated.

In another example, if a first free spin symbol 1016 on first wheel 1004 is aligned with a second free spin symbol 1018, the free spins may be awarded. In another example, if a first 100 credits symbol 1020 on first wheel 1004 is aligned with a second 100 credits symbol 1022, the 100 credits may be awarded. The symbols may have to align to form a word, a number, and/or any other image. For example, a first number 1024 may have to align with a second number 1026 to obtain the winning award of 1500 credits. In another example, a first symbol on first wheel 1004 may have a first portion of a car and a second symbol on second wheel 1008 may have a second portion of a car. In order for the car to be won both symbols (e.g., first symbol and second symbol) may need to align to form a full car image. In another example, a first symbol on first wheel 1004 may have a first portion of a word (e.g., progre) and a second symbol on second wheel 1008 may have a second portion of the same word (e.g., ssive). In order for the progressive to be won both symbols (e.g., first symbol and second symbol) may need to align to form the word progressive. In another example, a first multiplier symbol 1028 may have to align with a second multiplier symbol 1030 to obtain the multipliers as a winning award.

Figure 11A:
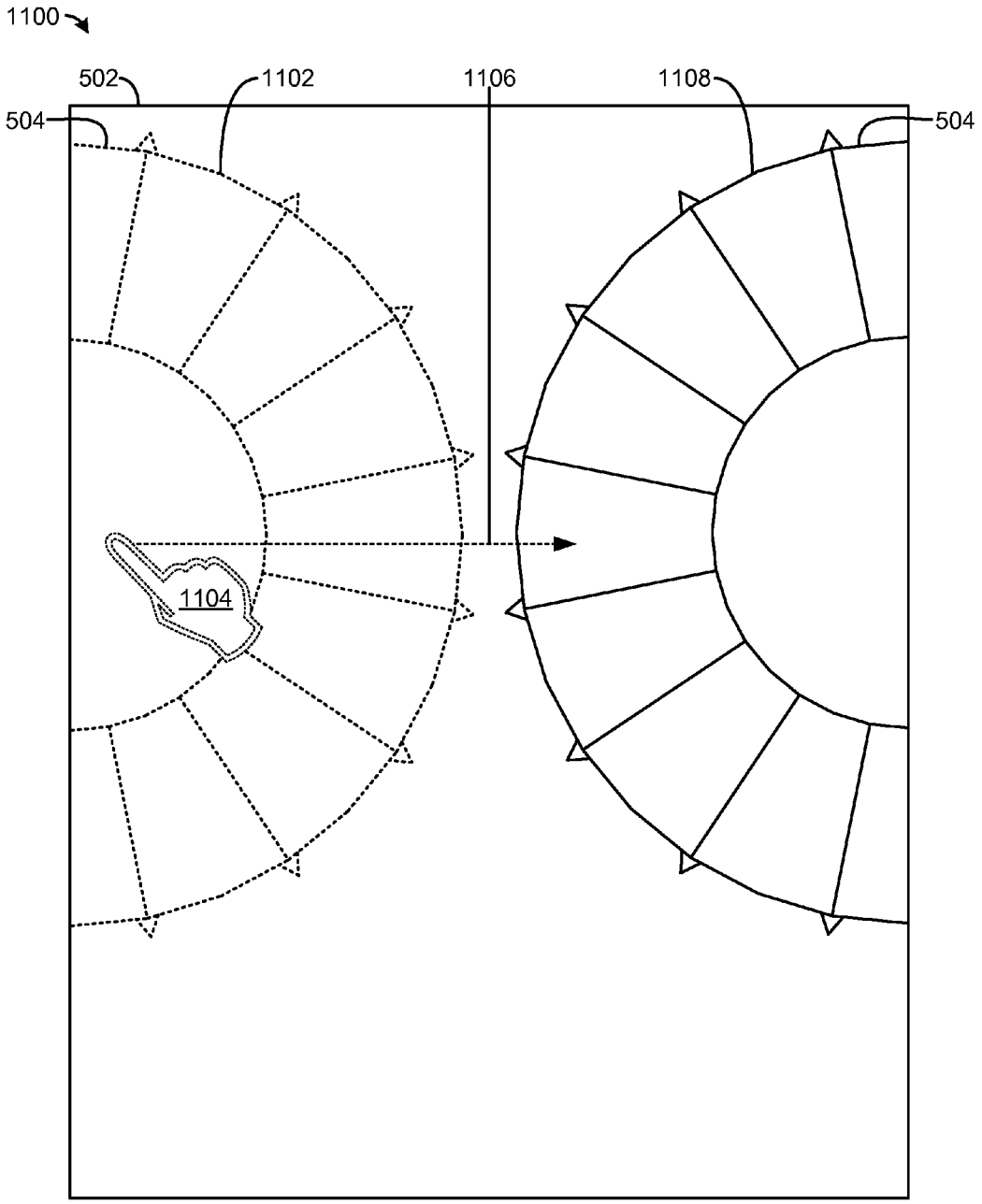
FIG. 11A is another illustration of a wheel-based game play, according to one embodiment.

FIG. 11A is an illustration of a wheel-based game play, according to one embodiment. In this example, a seventh image 1100 may show wheel 504 being moved from a first wheel position 1102 to a second wheel position 1108. This movement may be determined by a player's dragging movement 1104.

Figure 11B:
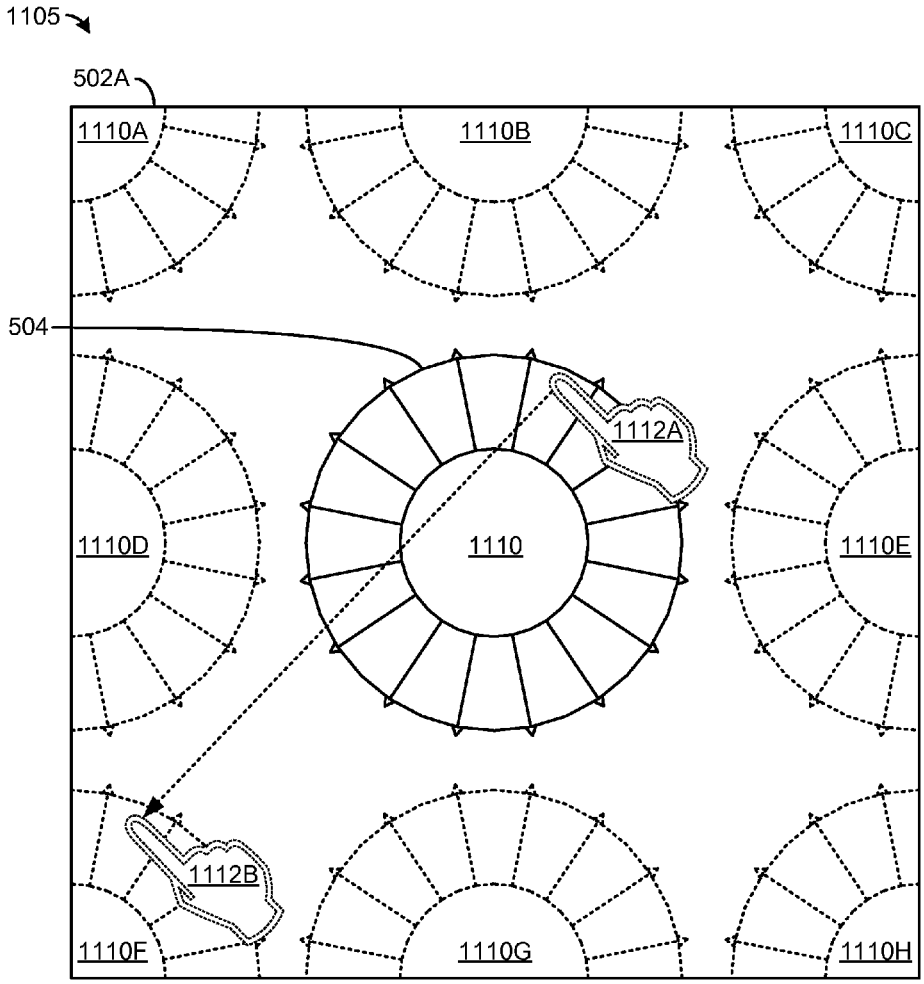
FIG. 11B is another illustration of a wheel-based game play, according to one embodiment.

FIG. 11B is an illustration of a wheel-based game play, according to one embodiment. In this example, an eighth image 1105 may show that wheel 504 may be moved from a third wheel position 1110 to a fourth wheel position 1110A, a fifth wheel position 1110B, a sixth wheel position 1110C, a seventh wheel position 1110D, an eighth wheel position 1110E, a ninth wheel position 1110F, a tenth wheel position 1110G, an eleventh wheel position 1110H, and/or any other position.

Figure 12:
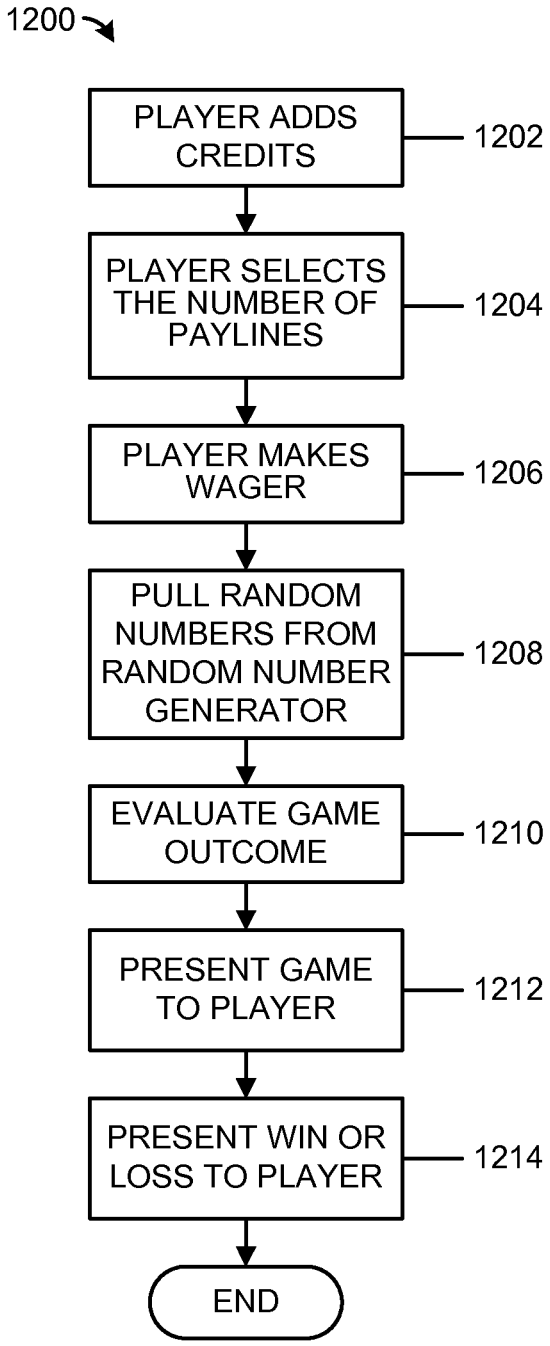
FIG. 12 is a flow diagram for game play, according to one embodiment.

FIG. 12 is a flow chart 1200 for game play, according to one embodiment. The method may include the player adding credits (step 1202). The method may further include the player selecting one or more paylines (step 1204). The method may include the player making a wager on one or more paylines (step 1206). The method may include pulling one or more random numbers via a random number generator (step 1208). The method may include electronic gaming device 100 and/or electronic gaming system 200 evaluating the game outcome (step 1210). The method may include presenting an outcome to a player (step 1212). The method may present a win or a loss to the player (step 1214). The method may end.

Figure 13:
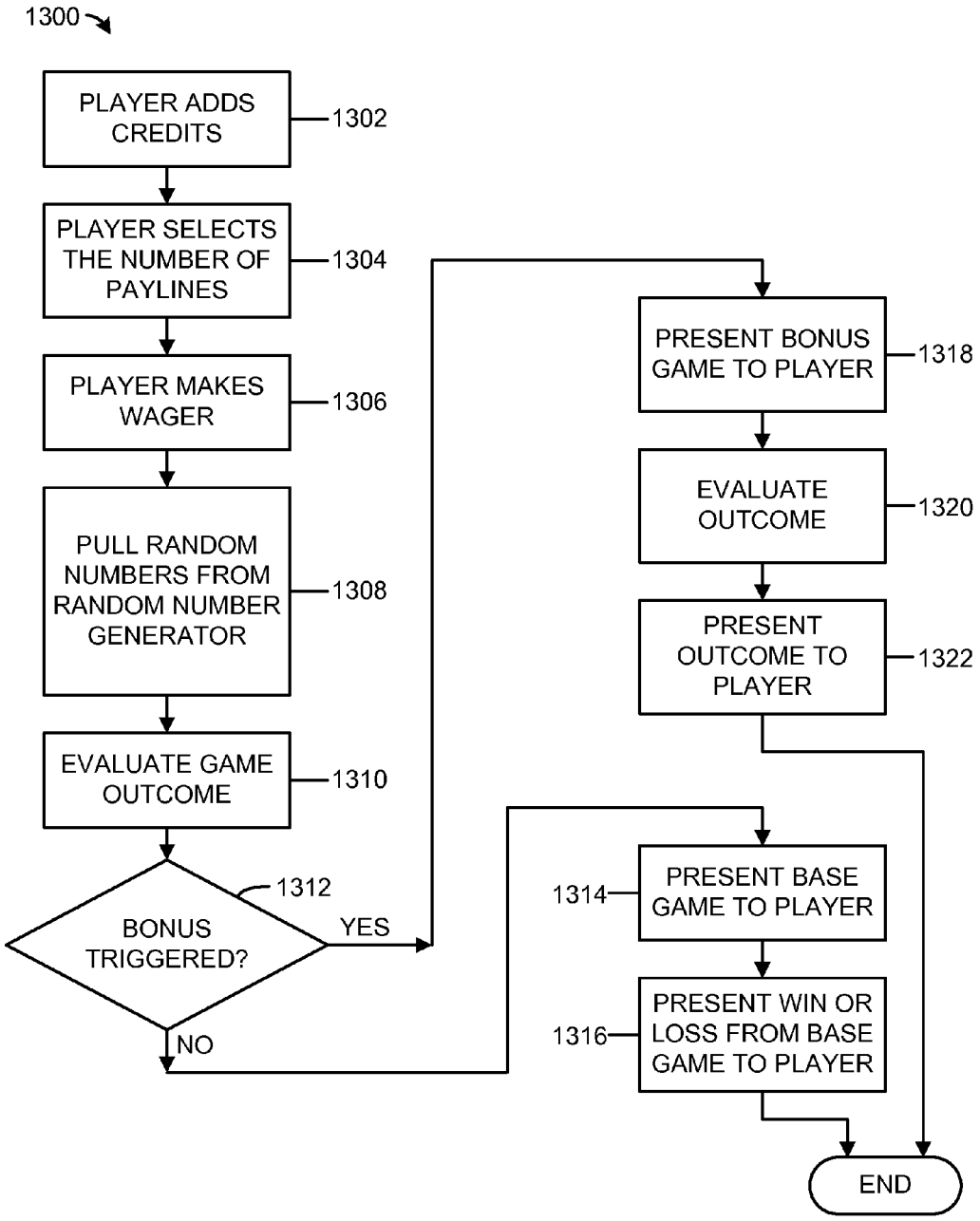
FIG. 13 is another flow diagram for game play, according to one embodiment.

FIG. 13 is a flow diagram for game play 1300, according to one embodiment. The method may include the player adding credits (step 1302). The method may further include the player selecting one or more paylines (step 1304). The method may include the player making a wager on one or more paylines (step 1306). The method may include pulling one or more random numbers via a random number generator (step 1308). The method may include electronic gaming device 100 and/or electronic gaming system 200 evaluating the game outcome (step 1310). The method may include electronic gaming device 100 and/or electronic gaming system 200 determining whether a bonus game has been triggered (step 1312). If no bonus game has been triggered, then the method may include presenting a base game outcome to a player (step 1314). The method may present a win or a loss from a base game to the player (step 1316) and the method may end. If a bonus game has been triggered, then the method may include presenting a bonus game to the player (step 1318). The method may include evaluating the bonus game outcome (step 1320). The method may include presenting the bonus game outcome to the player (step 1322) and the method may end.

For example, one or more bonus game triggers may initiate a wheel-based game play. The player, electronic gaming device 100, and/or electronic gaming system 200 may spin one or more wheels. In another embodiment, one or more wheel spins may be continually initiated until a stopper has been selected (e.g., landed on). In another embodiment, one or more wheel spins may be based on a number of chances (e.g., spins, turns, attempts, etc.).

One or more presentations may be based on a first theme (e.g., pirates), a second theme (e.g., cars), a third theme (e.g., horses), a fourth theme (e.g., perceived skill), a fifth theme (e.g., a specific movie), a sixth theme (e.g., a sporting event), a seventh theme (e.g., outer space), an eight theme (e.g., flowers), a ninth theme (e.g., food), a tenth theme (e.g., a skill based presentation), an eleventh theme (e.g., trivia), a twelve theme (e.g., pick a bonus), a thirteenth theme (e.g., ghost), a fourteenth theme (e.g., natural events), on a fifteenth theme (e.g., a mineral—gold, silver, etc.), and/or a sixteenth theme (e.g., mythology). One, a few, a plurality, and/or all of these presentations may be themed based.

Figure 14:
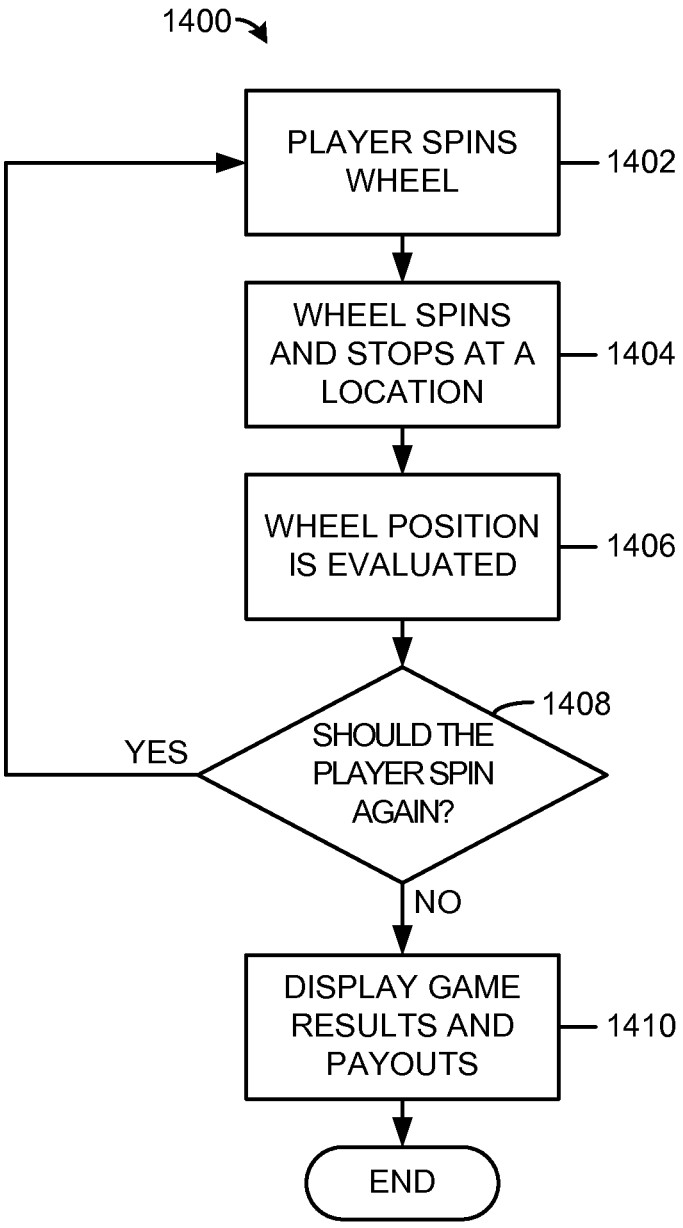
FIG. 14 is another flow diagram for game play, according to one embodiment.

In FIG. 14, a flow diagram for game play 1400 is shown, according to one embodiment. The method may include the game starting. The method may include the player spinning the wheel (step 1402). The method may include the wheel spinning and stopping at a location (step 1404). The method may include electronic gaming device 100 and/or electronic gaming system 200 evaluating the position of the wheel (step 1406). The method may include electronic gaming device 100 and/or electronic gaming system 200 determined whether the player should spin again (step 1408). If the player should not spin again, then the method may include displaying the game results and payouts (step 1410) and the method may end. If the player should spin again, then the method may include moving back to step 1402.

For example, a player may spin wheel 504 and land on a spin again spot. In addition, the player may have any number (e.g., 1 to Nth) of chances to spin wheel 504. In one example, the player may spin wheel 504 three times. After the first wheel spin, electronic gaming device 100 and/or electronic gaming system 200 may indicate that the player has 2 remaining spins. After the second wheel spin, electronic gaming device 100 and/or electronic gaming system 200 may indicate that the player has 1 remaining spins. After the third wheel spin, electronic gaming device 100 and/or electronic gaming system 200 may indicate that the player has 0 remaining spins.

Figure 15:
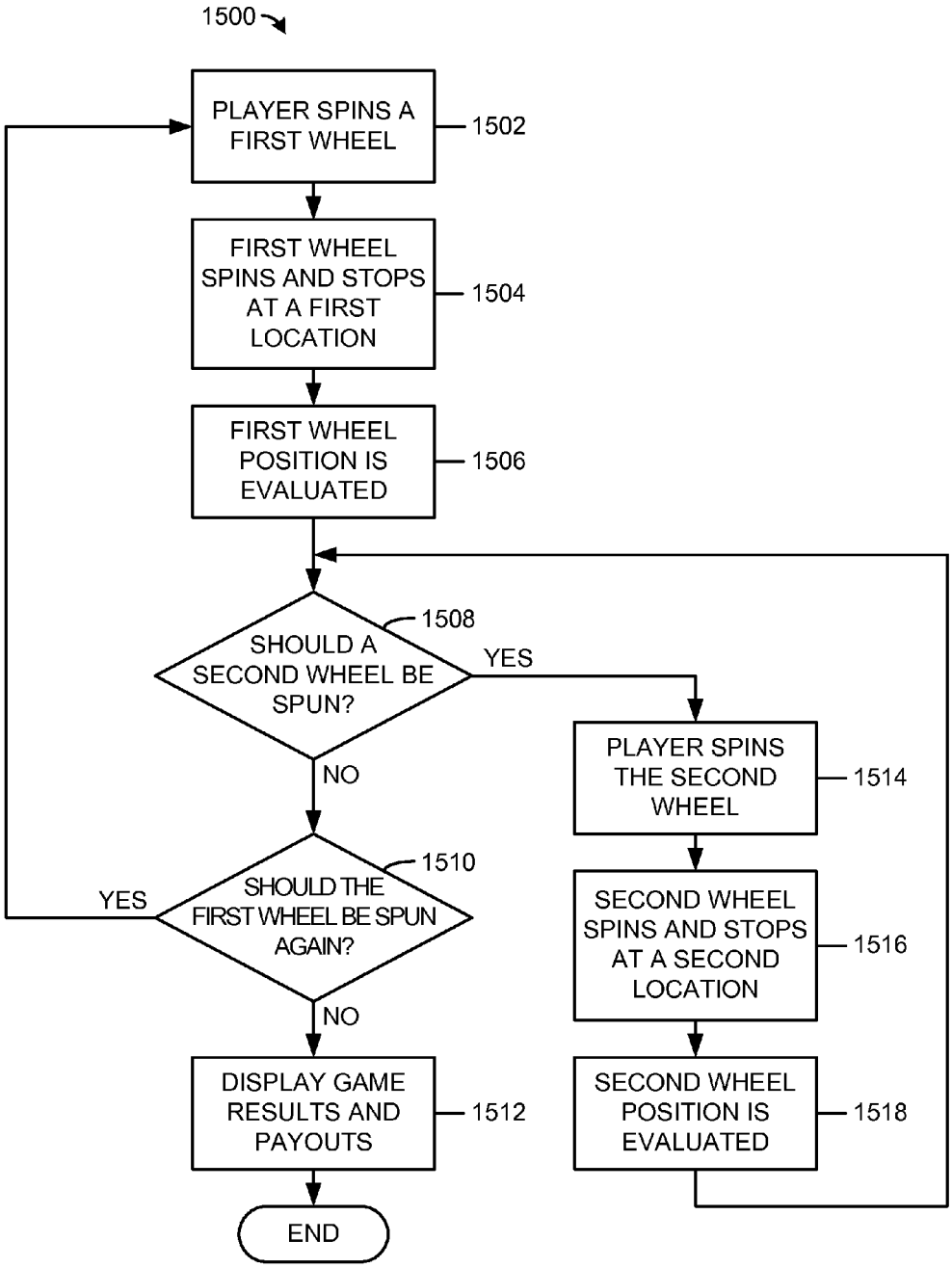
FIG. 15 is another flow diagram for game play, according to one embodiment.

FIG. 15 is a flowchart 1500 for game play, according to one embodiment. The method may include starting game play. The method may include the player spinning a first wheel (step 1502). The method may include the first wheel spinning and stopping at a first location (step 1504). The method may include electronic gaming device 100 and/or electronic gaming system 200 evaluating the position of the first wheel (step 1506). The method may include electronic gaming device 100 and/or electronic gaming system 200 determining whether a second wheel should be spun (step 1508). If the second wheel should be spun, then the method may include the player spinning the second wheel (step 1514). The method may also include the second wheel spinning and stopping at a second location (step 1516). The method may include electronic gaming device 100 and/or electronic gaming system 200 evaluating the location of the second wheel (step 1518) and then the method moves back to step 1508 to determine whether the second wheel should be spun again. If the second wheel should not be spun, then the method may include electronic gaming device 100 and/or electronic gaming system 200 determined whether the first wheel should be spun again (step 1510). If the first wheel should be re-spun, then the method moves back to step 1502. If the first wheel should not be re-spun, then the method may display game results and payouts (step 1512) and the method may end.

For example, the player may play a multi-wheel based game. The player may spin a first wheel which stops at a first location. The player may spin a second which and try to have the second wheel stop at a second location which matches one or more symbols on the first wheel to one or more symbols on the second wheel (see FIG. 10B).

In another example, the player may be allowed to spin one or more of the first wheel and/or the second wheel more than once. For example, the player may spin the first wheel and not be happy with the position of the first wheel. Therefore, the player may select to re-spin the first wheel. In another example, the player may spin the second wheel and not be happy with the position of the second wheel. Therefore, the player may select to re-spin the second wheel. In another example, after both the first wheel and the second wheel have been spun, the player may elect to re-spin the first wheel and/or the second wheel.

Figure 16:
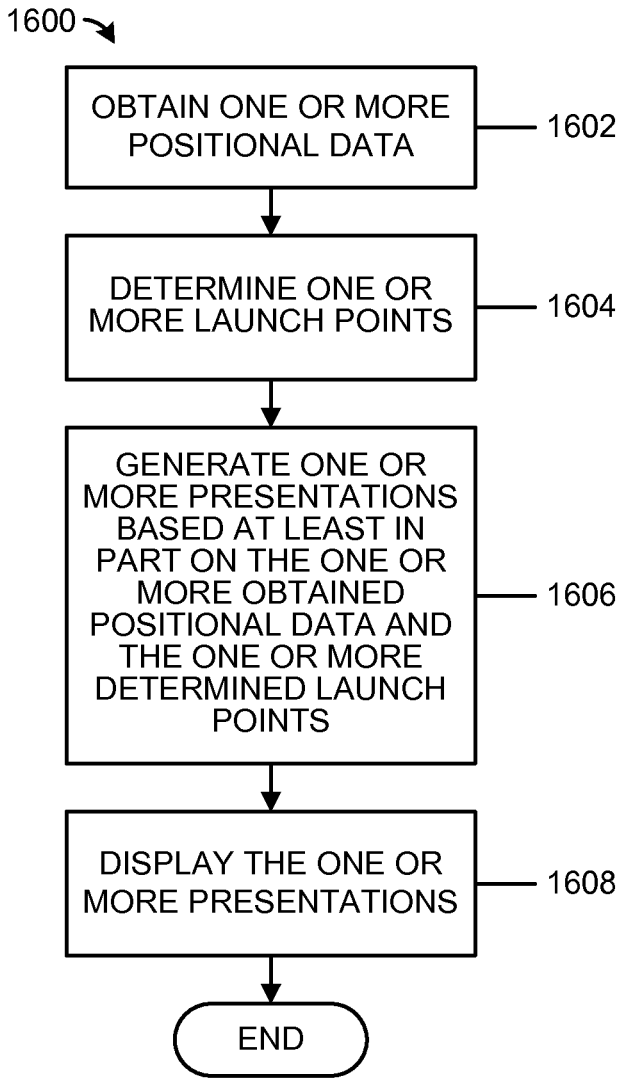
FIG. 16 is another flow diagram for game play, according to one embodiment.

In FIG. 16, a process flow for game play 1600 is shown, according to one embodiment. The method may include obtaining one or more positional data (step 1602). The method may include determining one or more launch points (step 1604). The method may include generating one or more presentations based at least in part on the one or more obtained positional data and the one or more determined launch points (step 1606). The method may display the one or more presentations (step 1608).

For example, a first launch point may indicate that the presentation should be a presentation where the wheel appears to tilt. In another example, a second launch point may indicate that the presentation should have a fire theme. In another example, a third launch point combined with a second launch point may indicate that the presentation should have a first speed. In another example, a fourth launch point may indicate that the presentation should have a first angle. In another example, a fifth launch point and a first tension setting may indicate that the presentation should have a rugged appearance.

In one example, the method may include determining a triggering event (e.g., a winning credit amount). The method may include looking up one or more presentations relating to the triggering event (e.g., a winning credit amount). The method may include selecting one or more presentations from the one or more presentations related to the triggering event (e.g., a winning credit amount) based on one or more criteria. The method may include displaying the selected one or more presentations. The method may end.

In one example, the system and/or method may determine that a key value (e.g., winning amount) is 10,000 credits. The key value may be the amount of credits (and/or multipliers and/or free spins and/or any other item of value) won. In this example, the 10,000 credit key value number may be utilized to determine one or more presentations associated with this 10,000 credits key value number. There may be presentation indexes numbered 0 to N associated with the 10,000 credits key value number.

The system and/or method may select (e.g., randomly, by a predetermined pattern, shuffle, combination thereof, and/or any other selection method) one or more of the presentations based on the key value.

In one example, the method may include determining a winning credit amount. The method may include looking up one or more presentations related to the winning credit amount. The method may include modifying the set of presentations relating to the winning credit amount based on one or more criteria. The method may include selecting a presentation from the modified set of presentations based on one or more criteria. The method may include displaying the selected presentation. The method may end.

For example, the presentation may be modified to include an advertisement, a movie trailer, a movie promotion, a casino event, a casino promotion, an actor's image, the player's image, etc.

In one embodiment, the electronic gaming device may include a plurality of reels, one or more paylines formed on at least a portion of the plurality of reels, a memory, and a processor. The memory may include a presentation module. The presentation module may include a plurality of presentations. The processor may determine a value. The processor may select one or more presentations based on the value.

In another example, the processor may randomly select the one or more presentations related to the value. In an example, the processor may select the one or more presentations related to the value in a predetermined pattern.

In another example, the value may be based on an input from a player. In an example, the processor may display a presentation based on one or more presentations. In another example, the processor may display a themed presentation based on one or more criteria. In an example, the themed presentation may be based on an advertisement and/or any other theme.

In another embodiment, the method of providing gaming options via an electronic gaming device may include receiving one or more primary wagers on one or more paylines, starting a bonus game, determining one or more values, and/or selecting one or more presentations based on the one or more values.

In an exemplary embodiment, an electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor. The processor may receive primary wagers on one or more paylines. The processor may receive one or more secondary wagers on one or more selected paylines (e.g., repeat paylines, patterns, scenarios, etc.). The selected paylines may be based on data received from a player. The processor may determine a selected payline's payout based on the one or more selected paylines (e.g., repeat paylines, patterns, scenarios, etc.).

In another embodiment, the processor may determine a payout based on the primary wagers. The electronic gaming device may include a network interface, which may receive data from at least one of a server and one or more gaming devices. The electronic gaming device may include a display, which may display one or more selected paylines.

In another example, the display may shade one or more non-selected paylines. The electronic gaming device may include a player preference input device. The player preference input device may modify a game configuration based on data from an identification device. The processor may multiply a prize value based on a selected payline occurrence.

In another example, the method may include obtaining a player preference data and modifying a game configuration based on the player preference data. The method may include receiving data from at least one of a server and one or more gaming devices.

In another example, the processor may determine a payout based on the primary wagers. The processor may receive one or more secondary wagers on one or more patterns. The electronic gaming device may include a display, which may display a game status image.

In another example, the method may include displaying a game status image. The method may also include shading one or more completed objectives (e.g., selecting any element, obtaining a repeat payline, etc.).

In another example, the method may include displaying paylines based on the one or more primary wagers. The method may include displaying the one or more repeat paylines. The method may include highlighting one or more repeat paylines. The method may include obtaining a player preference data and modifying a game configuration based on the player preference data.

In another embodiment, the electronic gaming system may include a server. The server may include a server memory, a server processor, and a signage server. The server memory may include historical gaming data. The server processor may generate a gaming message based on the historical gaming data. The signage server may transmit the gaming message.

In another example, the gaming message may be transmitted to an internal display of a gaming entity. The internal display may be a non-gaming device display. The gaming message may be transmitted to an external display of a gaming entity. The external display may be located outside of a gaming entity. The gaming message may be transmitted to at least one of a top display, a main display, and a side display.

The plurality of reels may form a 5-by-5 matrix, a 3-by-5 matrix, a 4-by-5 matrix, a 4-by-3 matrix, a 5-by-3 matrix, or any number-by-any number matrix. The symbols may be an image of a card, an image, and/or other objects. For example, it could be a pot of gold, an ace of spades, a diamond, or any other symbol. The symbols may be animation. The symbols may be a picture. For example, it may be a picture of the player as taken by camera 312. The symbols may be a number. The symbols may be any image. The symbols may be blank.

The disclosed features may be part of the base game and/or a bonus game. In addition, the disclosed features may be part of a base bet and/or may require an additional side bet (e.g., ante bet).

In one embodiment, the electronic gaming device may include a plurality of reels. One or more paylines may be formed on at least a portion of the plurality of reels. The electronic gaming device may include a memory. The memory may include one or more wheel-based game play structures. The electronic gaming device may include a processor. The processor may initiate one or more wheel-based game play structures based on a triggering event. One or more initiated wheel-based game play structures may be based on a dot product of an arc cosine of an angle between a first vector and a second vector.

In another example, the one or more initiated wheel-based game play structures may be based on a first area related to the first vector. In another example, the one or more initiated wheel-based game play structure may be based on a second area related to the second vector. In another example, the one or more initiated wheel-based game play structures may be based on one or more wheel rings.

In one example, the processor may change a wheel speed based on one or more wheel rings. In another example, the processor may determine a prize based on one or more wheel positions. In another example, the processor may display a payout based on the prize. In another example, the processor may determine whether more than one wheel-based game play structures should be initiated.

In one embodiment, the method may include receiving one or more wagers on one or more paylines. The method may include determining one or more triggering events. The method may include displaying one or more wheel-based game play structures. The method may include that the one or more initiated wheel-based game play structures may be based on a dot product of an arc cosine of an angle between a first vector and a second vector.

In another example, the method may include initiating the one or more initiated wheel-based game play structures based on a first area related to the first vector. In another example, the method may include initiating the one or more initiated wheel-based game play structures based on a second area related to the second vector. In another example, the method may include initiating the one or more initiated wheel-based game play structures based on one or more wheel rings.

In another example, the method may include changing a wheel speed based on one or more wheel rings. In another example, the method may include determining a prize based on one or more wheel positions. In another example, the method may include displaying a payout based on the prize. In another example, the method may include determining whether more than one wheel-based game play structures should be initiated.

In one embodiment, the electronic gaming system may include a server. The server may include a server memory and a server processor. The server memory may include one or more wheel-based game play structures. The server processor may initiate the one or more wheel-based game play structures based on a triggering event. The one or more initiated wheel-based game play structures may be based on a dot product of an arc cosine of an angle between a first vector and a second vector.

In one example, the one or more initiated wheel-based game play structures may be based on a first area related to the first vector. In another example, the one or more initiated wheel-based game play structure may be based on a second area related to the second vector. In another example, the one or more initiated wheel-based game play structures may be based on one or more wheel rings.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

a credit device configured to accept an item associated with a monetary value;

a plurality of display areas;

one or more paylines formed on at least a portion of the plurality of display areas;

a memory, the memory including one or more wheel-based game play structures; and a processor configured to determine a wager amount for a game play and to initiate game play based on the wager amount where the wager amount is subtracted from a credit balance, the credit balance being funded at least in part via the credit device, the processor configured to initiate the one or more wheel-based game play structures based on a triggering event and to implement a display of a wheel-based game play structure on at least a first display area of the plurality of display areas based on the triggering event where the wheel-based game play structure is a wheel presentation with one or more wheel speeds which are based on a product of a first magnitude of a first vector, a second magnitude of a second vector, and a cosine of an angle between the first vector and the second vector, the processor configured to determine a first payout based on the game play and to determine a second payout based on the wheel presentation, the processor configured to display at least one of the first payout and the second payout where the credit balance is increased by any determined award amounts associated with the first payout and the second payout;

wherein a first initiated wheel-based game has a first wheel speed based on a first friction data associated with the first initiated wheel-based game where the first friction data is modifiable by a player.

2. The electronic gaming device of claim 1, wherein the one or more initiated wheel-based game play structures are further based on a first area related to the first vector.

3. The electronic gaming device of claim 2, wherein the one or more initiated wheel-based game play structures are further based on a second area related to the second vector.

4. The electronic gaming device of claim 1, wherein the one or more initiated wheel-based game play structures are further based on a contact with one or more wheel rings.

5. The electronic gaming device of claim 4, wherein the processor is further configured to change the first wheel speed based on one or more wheel rings being utilized during wheel-based game play.

6. The electronic gaming device of claim 1, wherein the processor is configured to determine a prize based on one or more wheel positions.

7. The electronic gaming device of claim 6, wherein the processor is further configured to display a third payout based on the prize.

8. The electronic gaming device of claim 1, wherein the processor is further configured to determine whether more than one wheel-based game play structures should be initiated.

9. A method of providing gaming options via an electronic gaming device comprising:

receiving via a credit device an item associated with a monetary value;

establishing via one or more processors a credit balance based at least in part on the received item;

receiving via the one or more processors one or more wagers on one or more paylines where the one or more wagers are deducted from the credit balance;

determining via the one or more processors one or more triggering events;

displaying via the one or more processors one or more wheel-based game play structures; and generating via the one or more processors a payout where the payout is added to the credit balance;

wherein one or more initiated wheel-based game play structures are wheel presentations with one or more wheel speeds which are based on a product of a first magnitude of a first vector, a second magnitude of a second vector, and a cosine of an angle between the first vector and the second vector;

wherein a first initiated wheel-based game has a first wheel speed based on a first starting contact area on a display where each starting contact area is where a player first touches the display;

wherein the first starting contact area is dependent on a first number of player's fingers utilized to touch the display;

wherein the first starting contact area has a first size based on the first number of player's fingers utilized to touch the display which causes the first wheel speed;

wherein a second initiated wheel-based game has a second wheel speed based on a second starting contact area where the second starting contact area has a second size based on a second number of player's fingers utilized to touch the display which causes the second wheel speed where the first wheel speed is different than the second wheel speed based on the first starting contact area being different than the second starting contact area.

10. The method of claim 9, further comprising initiating the one or more initiated wheel-based game play structures based on a first area related to the first vector.

11. The method of claim 10, further comprising initiating the one or more initiated wheel-based game play structures based on a second area related to the second vector.

12. The method of claim 9, further comprising initiating the one or more initiated wheel-based game play structures based on a contact with one or more wheel rings.

13. The method of claim 12, further comprising changing the first wheel speed based on one or more wheel rings being utilized during game play.

14. The method of claim 13, further comprising determining whether more than one wheel-based game play structures should be initiated.

15. The method of claim 9, further comprising determining a prize based on one or more wheel positions.

16. The method of claim 15, further comprising displaying a prize payout based on the prize.

* * * * *